US007846555B2

(12) United States Patent
Tao et al.

(10) Patent No.: US 7,846,555 B2
(45) Date of Patent: Dec. 7, 2010

(54) PANEL FASTENING METHOD AND PANEL MEMBER FOR AUTOMOBILE

(75) Inventors: Sen Tao, Tochigi (JP); Keishi Okunaka, Tochigi (JP); Hirotatsu Koda, Tochigi (JP); Shinji Ago, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 958 days.

(21) Appl. No.: 11/668,845

(22) Filed: Jan. 30, 2007

(65) Prior Publication Data

US 2007/0296249 A1 Dec. 27, 2007

(30) Foreign Application Priority Data

Feb. 2, 2006 (JP) ..... 2006-025686
Mar. 24, 2006 (JP) ..... 2006-083263

(51) Int. Cl.
*B32B 3/04* (2006.01)
*B21D 19/08* (2006.01)
*B21D 19/12* (2006.01)
*B21D 37/08* (2006.01)

(52) U.S. Cl. ..... 428/583; 428/595

(58) Field of Classification Search ..... None
See application file for complete search history.

(56) References Cited

U.S. PATENT DOCUMENTS 2,692,664 A * 10/1954 Ternes ..... 52/222
3,244,131 A * 4/1966 Heinle ..... 413/12
3,478,917 A * 11/1969 Rouse et al. ..... 220/273
3,886,981 A * 6/1975 Eliason ..... 138/149
4,563,559 A * 1/1986 Enami ..... 219/756
4,626,158 A * 12/1986 Le Bret ..... 413/6
5,670,264 A * 9/1997 Sheridan ..... 428/594
5,860,265 A * 1/1999 Knudson et al. ..... 52/846
7,051,566 B2 * 5/2006 Baulier et al. ..... 72/306
2008/0100097 A1 * 5/2008 Tao et al. ..... 296/191

FOREIGN PATENT DOCUMENTS

| | | | |
|---|---|---|---|
| DE | 10317686 | A1 * | 4/2004 |
| EP | 136953 | * | 4/1985 |
| EP | 0 820 822 | | 8/1999 |
| JP | 57-62827 | | 4/1982 |
| JP | 7-124653 | | 5/1995 |
| JP | 2002-172446 | | 6/2002 |
| JP | 2003-170741 | | 6/2003 |

OTHER PUBLICATIONS

Machine translation of DE 10317686, Apr. 2004.*

* cited by examiner

*Primary Examiner*—John J Zimmerman
(74) *Attorney, Agent, or Firm*—Rankin, Hill & Clark LLP

(57) ABSTRACT

A panel member for an automobile includes a hem portion roll-fastened in a state of overlapping an outer panel and an inner panel. At the hem portion of the panel member, the outer panel and the inner panel are roll-fastened in a state that a front end face of the outer panel and a front end face of the inner panel are respectively rolled-in by the inner panel and the outer panel.

7 Claims, 20 Drawing Sheets

PANEL FASTENING METHOD AND PANEL MEMBER FOR AUTOMOBILE

This application claims foreign priority from Japanese Patent Application No. 2006-025686 (filed on Feb. 2, 2006) and No. 2006-083263 (filed on Mar. 24, 2006), the entire contents of which are hereby incorporated by reference.

BACKGROUND OF THE INVENTION

1. Field of the Invention

The present invention relates to a panel member for an automobile, particularly relates to a panel member for an automobile preferably used in an automatic two-wheel vehicle or an automatic four-wheel vehicle.

In addition, the present invention relates to a panel fastening method for roll-fastening a plurality of panels and a panel structure applied with the panel fastening method.

2. Related Art

In a background art, there is used a hemming structure of overlapping an outer panel and an inner panel and folding to bend a flange formed to erect at a hem portion of the outer panel to pinch in the inner panel at a hem portion of a panel member for an automobile of a bonnet, a trunk and a door or the like of an automobile.

For example, JP-A-2003-170741 describes a panel member of a door for an automobile in which a hem portion of an outer panel is fastened to a hem portion of an inner panel by folding to bend the hem portion of the outer panel to pinch in the hem portion of the inner panel.

FIG. 25 is a vertical sectional view cutting a hem portion of a panel member for an automobile according to a constitution of the background art in a plate thickness direction. In this case, as shown by FIG. 25, by further folding to bend a hem flange 100*b* of an outer panel 100 preparatorily bent substantially in an L-like shape, a front face 102*a* of an inner panel 102 is pinched in to fasten to thereby constitute a hem portion.

However, according to the constitution of FIG. 25, the inner panel 102 is only pinched in by the hem flange 100*b* of the outer panel 100 to fasten and therefore, there is concern of a deficiency in a fastening strength, and there is a case in which the deficiency in the strength is compensated for by also using an adhering agent, spot welding or the like. Further, in order to avoid a problem that the front end face 100*a* of the outer panel 100 is rusted by being exposed to outside, it is necessary to coat a seal member 104 of a dust sealer or the like (refer to FIG. 25). Therefore, there are needed a step of coating an adhering agent, a step of carrying out spot welding and a step of coating the seal member 104 and the like to pose a problem that a number of fabricating steps is increased.

Further, in bending to fasten a hem portion of a panel member requesting a three-dimensional shape having a number of radii of curvature at the hem portion as in a panel member for an automobile, in order to prevent a wrinkle from being brought about after having been fastened, only a hem flange of the portion of the radius of curvature needs to be smaller than a hem flange at other portion. Therefore, at a portion having a radius of curvature, for example, at a corner portion as shown in FIG. 26, in folding to bend the portion, a force in a direction indicated by an arrow mark of FIG. 27 is operated and therefore, a wrinkle is liable to be produced, there is not a method of dealing therewith other than shortening the hem flange 100*b* of the outer panel 100 at the corner portion, and the portion is inferior in view of an outlook thereof.

Furthermore, the portion of folding to bend the outer panel 100 is operated with a force in an arrow mark B direction in FIG. 25 (a direction widening from RO portion), the folded-to-bend portion is slightly rounded, so-to-speak sagging is brought about by increasing a radius of curvature RO and therefore, there poses a problem that the outlook is further deteriorated.

Further, JP-A-07-124653 describes that after a hemming step of folding to bend a hem portion of an outer panel to thereby pinch in a hem portion of an inner panel to fasten, there is carried out an after hem step of subjecting a hemmed portion formed by the hemming step to spot welding. The after hem step is carried out with an object of reinforcing a bonding strength of the hemmed portion.

FIG. 28 is a partially omitted vertical sectional view for explaining a panel structure fastened by the background art method. In this case, first, by further folding to bend a hem flange portion 300*b* including a front end face 300*a* of an outer panel 300 which has been preparatorily bent substantially in an L-like shape, a front end face 302*a* of an inner panel 302 is pinched in to fasten.

Successively, a hem portion fastened as described above is welded by a spot welding gun 304 (after hem step), at this occasion, when a strike mark or a thermal strain by the spot welding gun 304 remains at an outer surface 300*c* of the outer panel 300, an outlook of a product is deteriorated. Hence, at this occasion, a back bar 306 (lower die) in line with a shape of the outer surface 300*c* is brought into contact therewith, and welding is carried out in a state of butting an electrode only to a side of the hem flange portion 300*b*.

Meanwhile, according to the background art constitution, welding is carried out only from an upper side of FIG. 28, that is, the side of the hem flange portion 300*b* (indirect welding) and therefore, a bonding portion cannot be pressed sufficiently, further, a shunt current is liable to be generated and therefore, it is difficult to achieve a sufficient bonding strength.

Further, a facility of a C gun type used in an ordinary spot welding apparatus or the like cannot be used to divert, further, also the back bar 306 matched to the shape of the work is also needed and therefore, there poses a problem that it is difficult to widely use the facility.

SUMMARY OF THE INVENTION

One or more embodiments of the present invention provide a panel member for an automobile providing a hem portion excellent in an outlook, having a high fastening strength and capable of reducing a number of fabricating steps in a panel member for an automobile requesting a three-dimensional shape having a number of radii of curvature at a hem portion.

In addition, one or more embodiments of the present invention provide a panel fastening method capable of promoting general purpose performance and capable of fabricating a panel including a hem portion having a sufficient bonding strength and excellent in an outlook and a panel structure applied with the panel fastening method.

In accordance with one or more embodiments of the present invention, a panel member for an automobile is provided with a hem portion constituted by fastening a plurality of overlapped plate members. The hem portion is roll-fastened in a state that respective front end faces of the respective plate members are rolled-in.

According to the constitution, even in a panel for an automobile requesting a three-dimensional shape having a number of radii of curvature, the hem portion excellent in an outlook and having a high fastening strength can be provided.

Further, when a face of the hem portion formed by a bent portion most remote from the front end face of the plate member on an outermost side and forming an outer end portion of the hem portion is referred to as an outer side end face, and a face thereof formed on a side opposed to the outer side end face of the plate member on the outermost side by interposing the front end face is referred to as an inner side end face, and when a radius of curvature of the inner side end face is designated by a notation (r), a total plate thickness of the respective plate members is designated by a notation (T), a plate thickness of the plate member on the outermost side is designated by a notation (t1), and a height of the outer side end face is designated by a notation (H), by satisfying an equation shown below $$t1 < r \leqq (h-T)/2$$

the front end face of the plate member on an inner side can firmly be pinched by the plate member on an outer side. Therefore, the fastening strength can be increased and the hem portion can be prevented from being damaged in being fastened. Further, the bent portion includes a bent portion which is folded to bend or a bent portion which is bent or the like.

Further, when the respective plate members are brought into contact with each other without producing a gap in a direction of overlapping the respective plate members each other at the hem portion, the fastening strength at the hem portion is further increased and the outlook is further promoted.

Furthermore, when in a section of the hem portion cut in a plate thickness direction of the plate member, a total area of respective gap portions brought into contact with the respective front end faces of the respective plate members which are rolled-in is designated by a notation (A), plate thicknesses of the respective plate members are designated respectively by notations (t1, t2, . . . , tn), and a circle rate is designated by a notation (π), by satisfying $$A \geqq \Sigma\{(ti/2)^{2/}2\}\pi(i=1, 2, \ldots, n)$$

sufficient gaps can be ensured for portions brought into contact with the respective front end faces of the plate member of the inner side and the plate member of the outer side and therefore, even when there are more or less variations in the plate thicknesses or the like of the respective plate members, the roll-fastening can firmly be carried out.

Further, in a case in which when a face of the hem portion formed by a bent portion most remote from the front end face of the plate member on the outermost side and forming the outer end portion of the hem portion is referred to as an outer side end face, an angle of bending the outer side end face from the plate member is equal to or smaller than 90°, sagging at the bent portion can be restrained and therefore, the outlook is further promoted. Further, the bent portion includes a bent portion which is folded to bend, a bent portion which is bent or the like.

According to the invention, even in a panel member for an automobile requesting a three-dimensional shape having a number of radii of curvature at a hem portion, the hem portion having an excellent outlook can be provided. Further, according to the invention, a fastening strength of the hem portion of the panel member for an automobile can be increased and a number of fabricating steps can be reduced.

Moreover, in accordance with one or more embodiments of the invention, a panel fastening method of fastening hem portions of a plurality of panels is provided with a positioning step of overlapping the respective panels to position relative to each other, a bonding step of bonding the respective panels positioned by the positioning step, and roll-fastening end portions of the respective panels bonded by the bonding step, and forming a hem portion in which front end faces of the respective panels are rolled-in. In the forming step, the panels are formed such that a bonding portion formed on the respective panels in the bonding step is rolled-in in the hem portion.

According to the method, by rolling-in the bonding portion at the hem portion, the bonding portion can made to be disposed at a position of not being conspicuous in an outlook thereof, an outlook of the panel after having been fastened can be promoted, further, a sufficient fastening strength can be achieved. Further, the panels are roll-fastened after bonding the panels and therefore, the panels can easily and properly be fastened by effectively preventing a positional shift between the panels in roll-fastening the panels.

Further, when in the bonding step, the respective panels are bonded at a position P of being remote from respective front end faces of the respective panels by predetermined distances, in finishing to form the panels, a shift on sides of the front end faces of the respective panels relative to the bonding portion can be permitted and therefore, a wrinkle can be restrained from being brought about after roll-fastening the panels and the respective panels can easily be formed.

Further, when a face of forming an outer end portion of the hem portion is referred to as an outer side end face, at the forming step, the panels are roll-fastened such that the bonding portion is disposed on an inner side of the outer side end face, the bonding portion is not conspicuous at the panel after having been fastened, which is particularly preferable in view of the outlook.

A panel structure of the invention is characterized in a panel structure including a hem portion at which a plurality of overlapped panels are fastened, wherein the respective panels include a bonding portion for bonding each other at a predetermined position, and roll-fastened to roll-in respective front end faces of the respective panels and constituted in a state of arranging the bonding portion on an inner side of the hem portion.

According to the constitution, a sufficient fastening strength can be achieved while making the bonding portion inconspicuous in the outlook and promoting the outlook of the panel.

Further, when a face of forming an outer end portion of the hem portion is referred to as an outer side end face, the bonding portion is disposed at a position on an inner side of the outer side end face, the bonding portion is not conspicuous, which is particularly preferable in view of the outlook.

According to the invention, after positioning the plurality of panels in the overlapped state, the panels are bonded, and roll-fastened such that the bonding portion is included in the hem portion after having been fastened. Therefore, according to the panel fastened by the invention, the bonding portion can be moved to the position which is inconspicuous in the outlook, the outlook can be promoted, further, the sufficient fastening strength can be achieved. Further, the panels are previously bonded and thereafter roll-fastened and therefore, the panels can easily and properly be fastened while effectively preventing a positional shift between the panels in roll-fastening the panels.

Other aspects and advantages of the invention will be apparent from the following description and the appended claims.

DETAILED DESCRIPTION OF THE EXEMPLARY EMBODIMENTS

Exemplary embodiments of the invention will be described with reference to the accompanying drawings.

<First Exemplary Embodiment>

Figure 1:
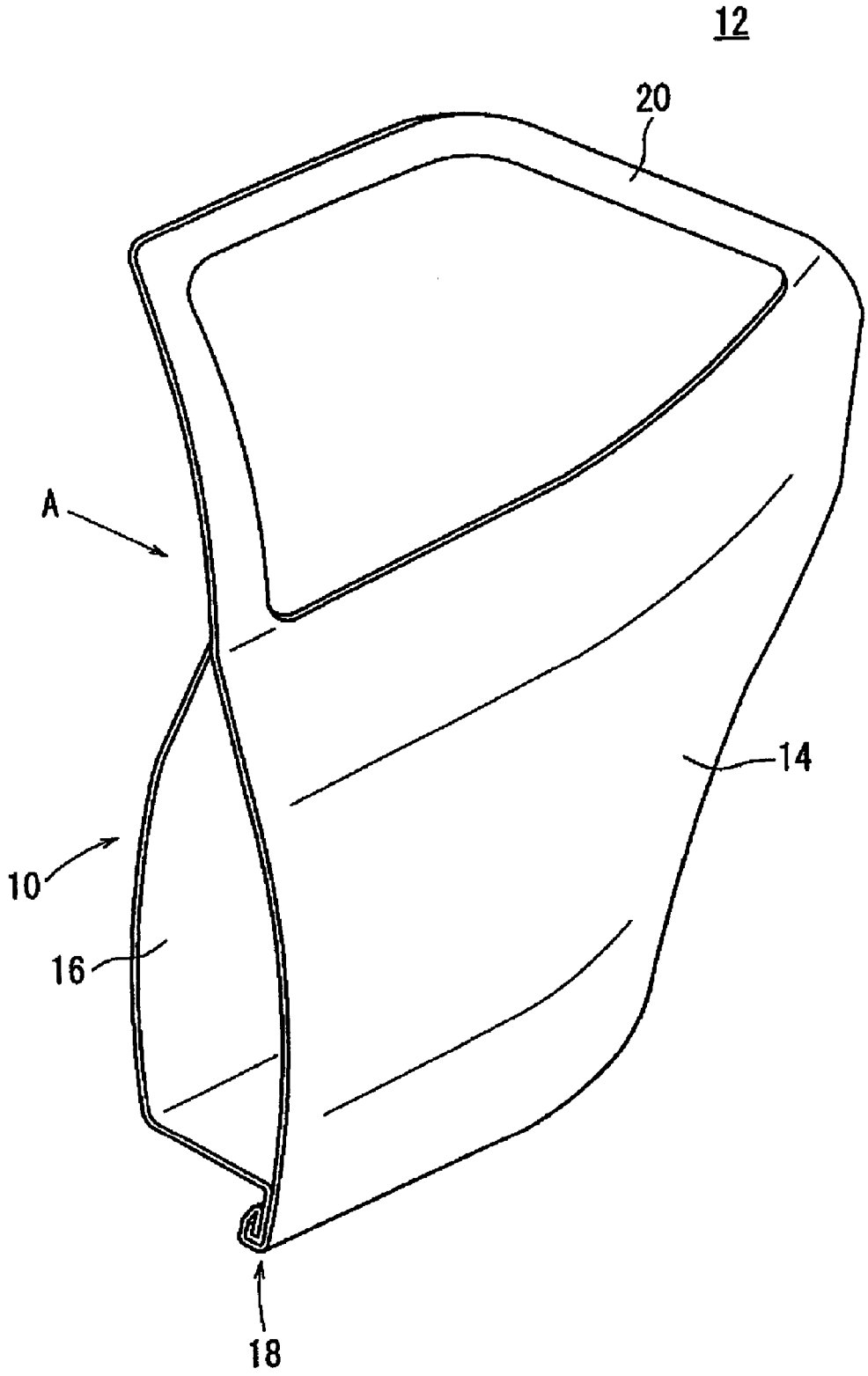
FIG. 1 is a partial perspective view of an automobile rear door constituting an example of applying a panel member for an automobile according to an exemplary embodiment of the invention.
Figure 2:
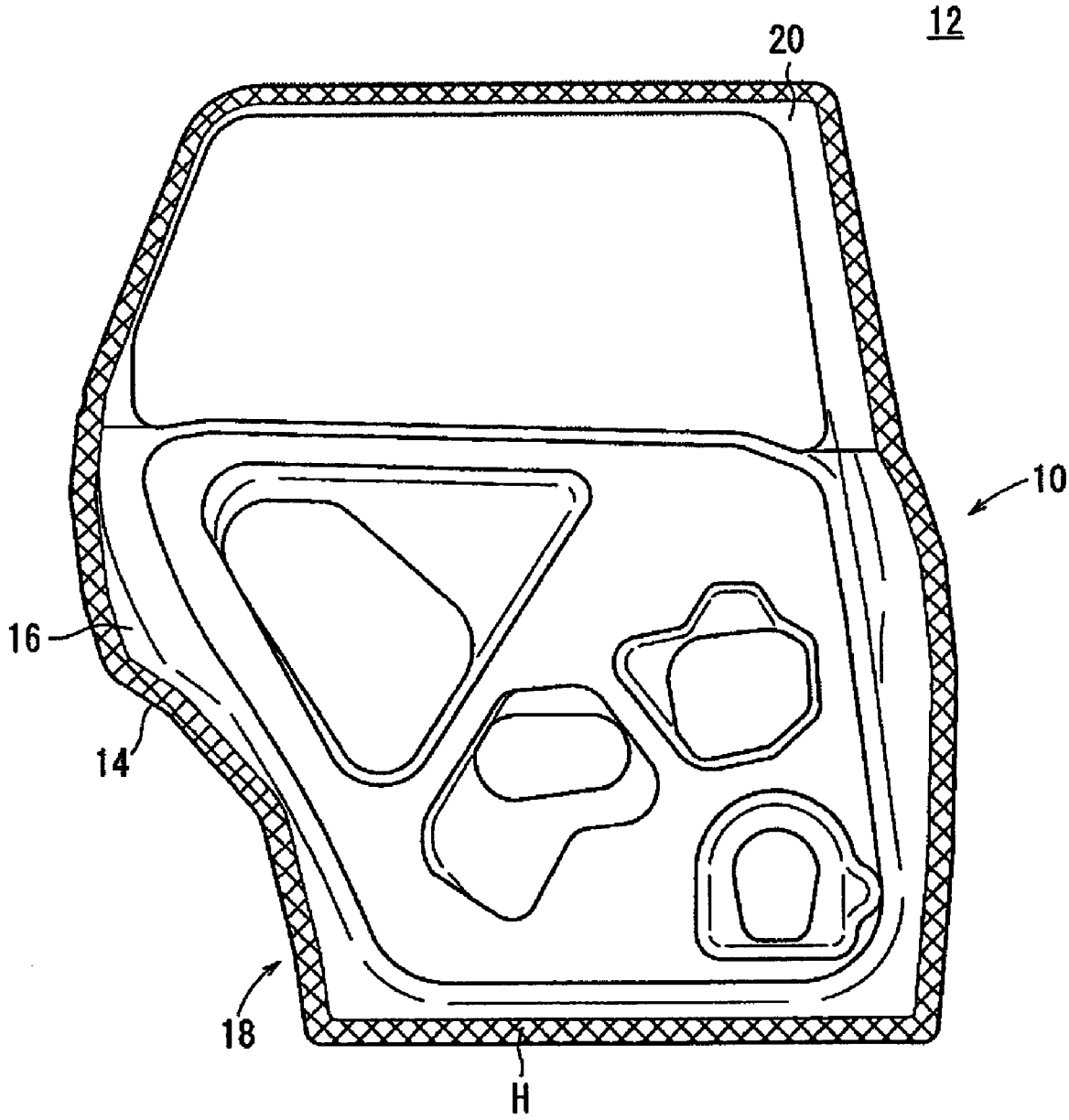
FIG. 2 is a front view of the automobile rear door viewed from an A arrow mark direction of FIG. 1.

FIG. 1 is a partial perspective view of an automobile rear door 12 constituting an example of applying a panel member 10 for an automobile according to a first exemplary embodiment of the invention. FIG. 2 is a front view of the automobile rear door 12 viewed from an A arrow mark direction in FIG. 1 (a direction of viewing the automobile rear door 12 from a vehicle inner side).

The automobile rear door 12 is constituted by the panel member 10 and a window frame 20 attached to an upper portion of the panel member 10. The panel member 10 is formed by fastening an outer panel 14 and an inner panel 16 constituting plate members by roll-fastening at a hem portion 18. The outer panel 14 and the inner panel 16 are formed, for example, by sheet metal materials (made of metal) punched in predetermined shapes.

The hem portion 18 formed by being roll-fastened as described above is, for example, a portion indicated by a strip-like netted portion H in FIG. 2, and is extended three-dimensionally over an entire periphery of the automobile rear door 12. Further, as shown by FIG. 3C, the hem portion 18 is formed by being roll-fastened by rolling-in a front end face 14*a* of the outer panel 14 and a front end face 16*a* of the inner panel 16.

Next, an explanation will be given of an example of a method of forming the hem portion 18 roll-fastened as described above in reference to FIG. 3A through FIG. 5.

Figure 3A:
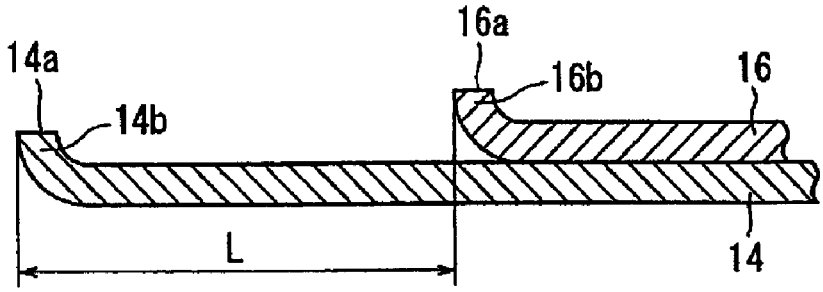
FIG. 3A is a vertical sectional view showing a state of overlapping an outer panel and an inner panel before fastening a hem portion of the panel member for an automobile.
Figure 3B:
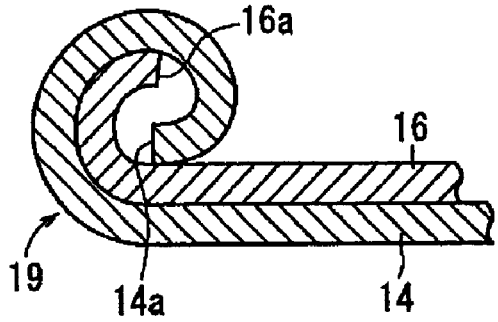
FIG. 3B is a vertical sectional view showing a state of curling the outer panel and the inner panel which are overlapped.
Figure 3C:
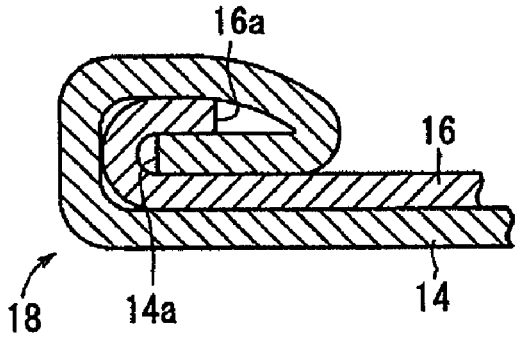
FIG. 3C is a vertical sectional view showing a state of seaming a hem portion subjected to curling as described above.

FIG. 3A is a vertical sectional view showing a state of overlapping the outer panel 14 and the inner panel 16 before fastening the hem portion of the panel member 10 according to the exemplary embodiment. FIG. 3B is a vertical sectional view showing a state of forming a hem portion 19 by roll-fastening (curling) a portion L constituted by shifting the overlapped outer panel 14 from the inner panel 16 substantially in a circular shape. FIG. 3C is a vertical sectional view showing a state of forming the hem portion 18 by forming (seaming) the curled hem portion 19 while deforming (pressing) the hem portion 19 to be flat.

First, as shown by FIG. 3A, the outer panel 14 and the inner panel 16 are overlapped. At this occasion, the outer panel 14 is arranged to be shifted from the inner panel 16 by the portion L. Further, in this case, front end portions having the front end face 14*a* and the front end face 16*a* of the outer panel 14 and the inner panel 16 are slightly bent previously to form a flange portion 14*b* and a flange portion 16*b* (preparatory bending).

Next, as shown by FIG. 3B, the portion L of the outer panel 14 is curled to be roll-fastened to form the hem portion 19 substantially in a circular shape.

Figure 4:
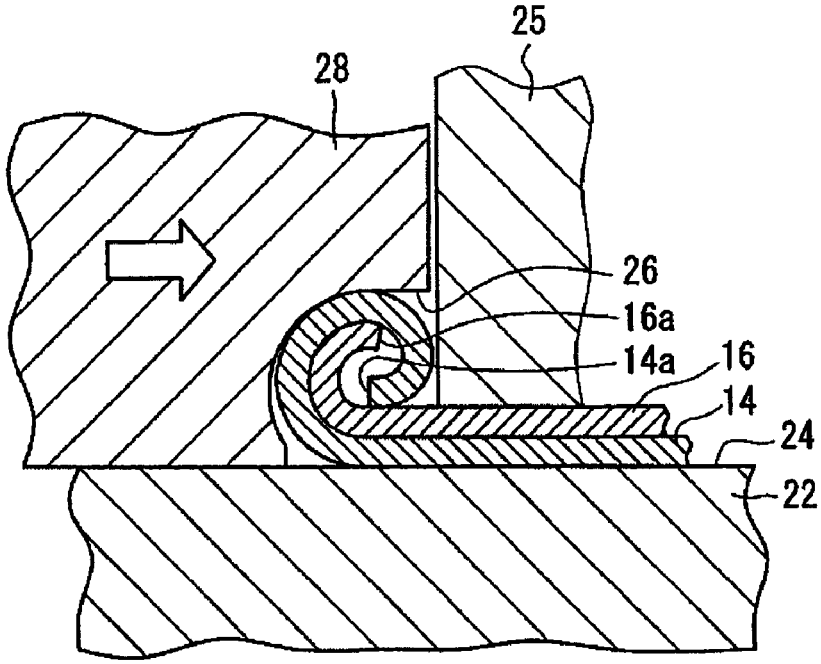
FIG. 4 is an explanatory view showing an example of a method of curling the hem portion of the panel member for an automobile.

As a curling method in this case, for example, as shown by FIG. 4, the outer panel 14 and the inner panel 16 which are overlapped are mounted on a mounting face 24 of a mounting base 22, and pressed to be fixed by a press pad 25. Thereafter, a curl punch 28 having a curl portion 26 is moved to roll-fasten the panels by sliding the curl punch 28 having the curl portion 26 on the mounting face 24. In this way, when the portion L of the outer panel 14 is formed substantially in the circular shape, the hem portion 19 having an excellent outlook can easily be provided.

Next, as shown by FIG. 3C, the hem portion 18 is formed by subjecting the hem portion 19 to a seaming process in which the hem portion 19 is pressed and deformed to be flat.

Figure 5:
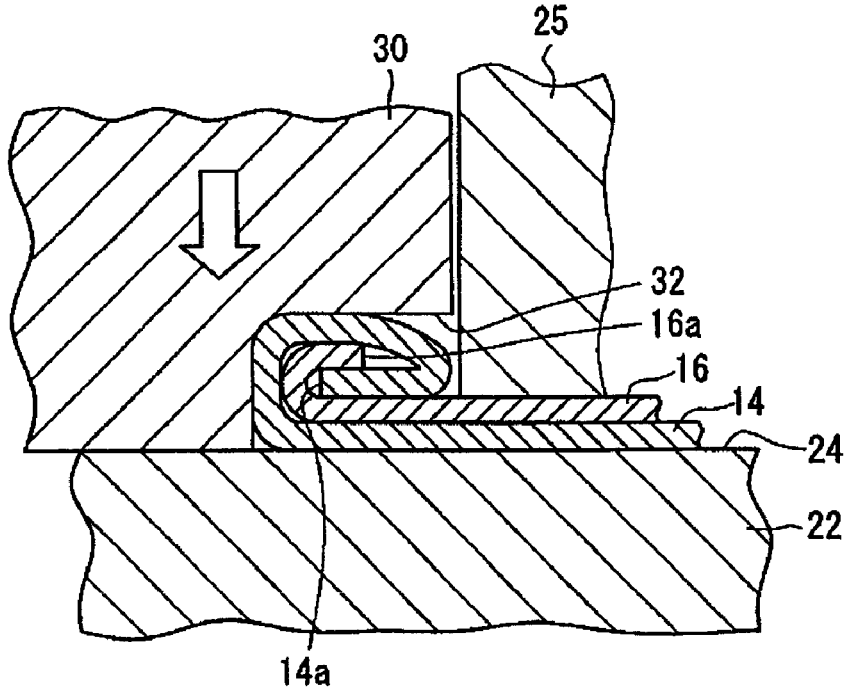
FIG. 5 is an explanatory view showing an example of a method of seaming the hem portion of the panel member for an automobile.

As the seaming process in this case, for example, as shown by FIG. 5, after the curling above the mounting face 24, in a state in which the outer panel 14 and the inner panel 16 are fixed by the press pad 25, the curl punch 28 is escaped, the hem portion 19 is seamed by deforming the hem portion 19 to be flat by a seam portion 32 of a seam punch 30. At this occasion, in a procedure of deforming from the hem portion 19 to the hem portion 18 to be flat, a plastic flow is produced in the outer panel 14 and the inner panel 16. Further, by the plastic flow, the portion of the radius of curvature R of the hem portion 18 can sufficiently be reduced by operating a force in an arrow mark A direction of FIG. 7 (a direction directed to R portion), sagging is prevented from being brought about and therefore, the hem portion 18 further excellent in the outlook can easily be provided.

Figure 8:
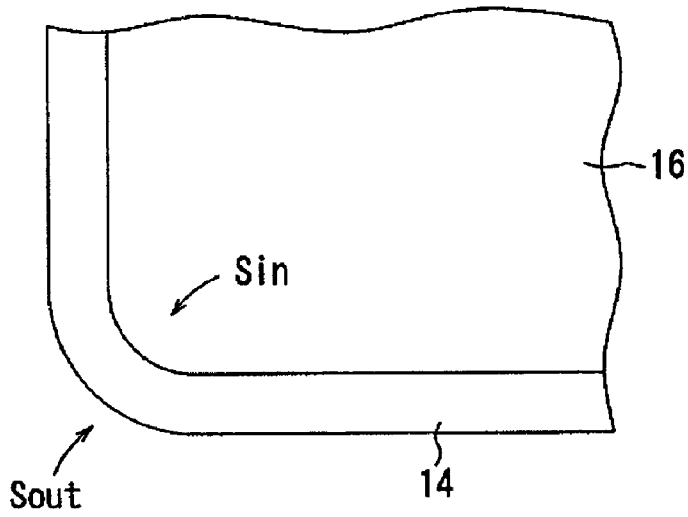
FIG. 8 is a plane view including a corner portion of the panel member for an automobile.
Figure 9:
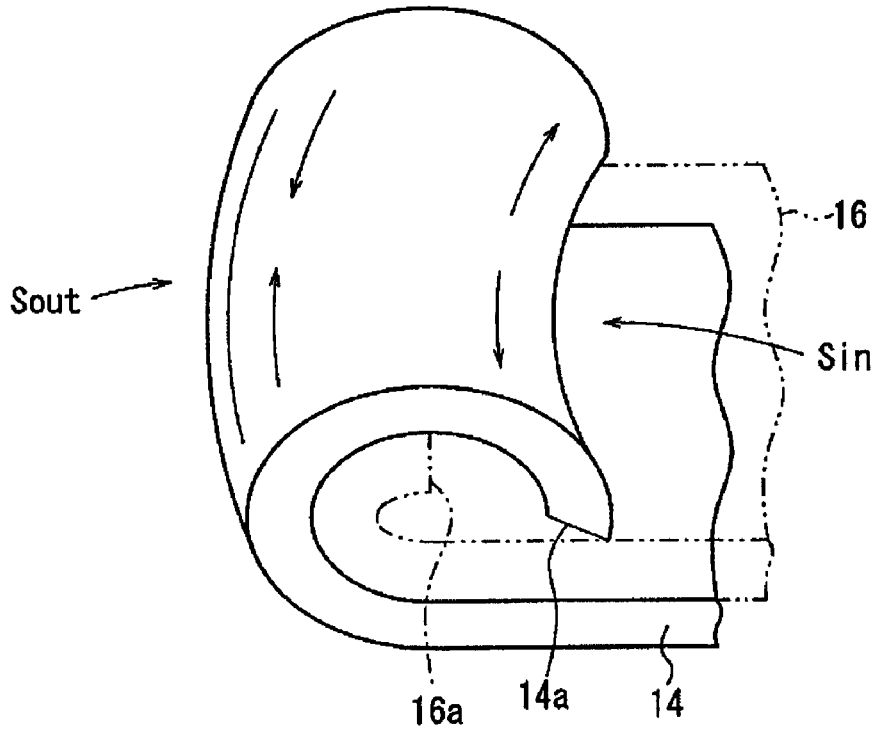
FIG. 9 is a perspective view enlarging the hem portion at the corner portion.
Figure 26:
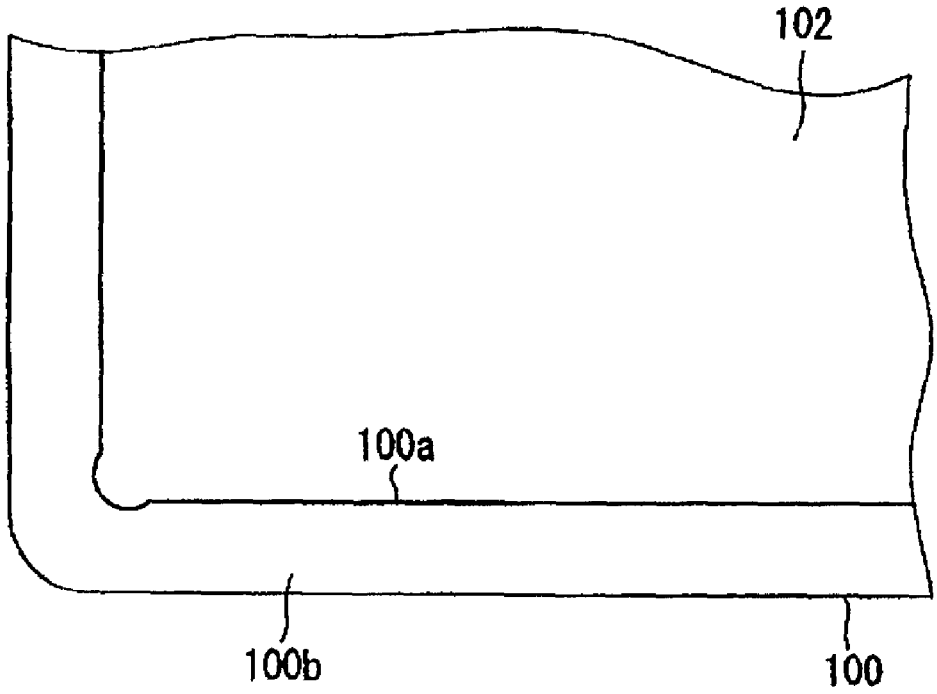
FIG.26 PRIOR ART
FIG. 26 is a plane view including a corner portion of the panel member for an automobile according to the background art method.
Figure 27:
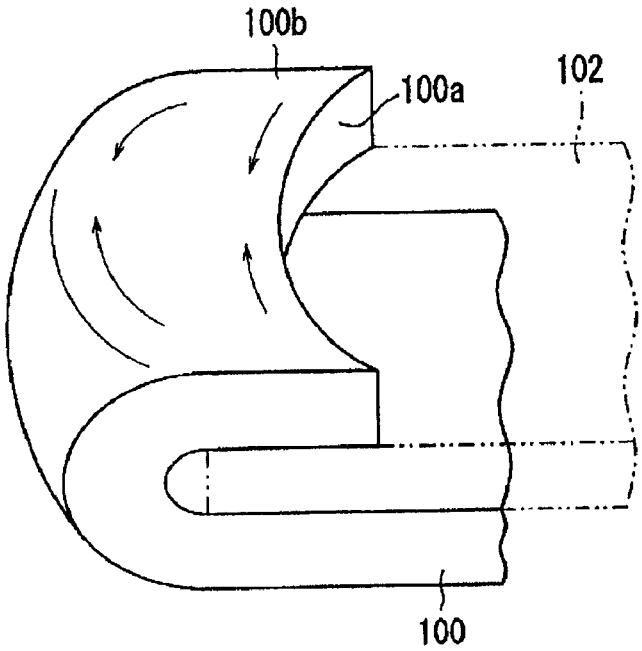
FIG.27 PRIOR ART
FIG. 27 is a perspective view enlarging a hem portion at the corner portion of the panel member for an automobile according to the background art method.

Further, according to the panel member 10, at a corner portion shown in FIG. 8, a force in a direction indicated by an arrow mark in FIG. 9 is operated in bending by being fastened by being seamed as described above. Thereby, a material is elongated at a portion in which a wrinkle is brought about by contracting the material in the background constitution (refer to FIG. 26 and FIG. 27) (Sin side) and therefore, even at a corner portion having a smaller radius of curvature, the corner portion can be formed while preventing a wrinkle from being brought about without shortening the flange length in preparatory bending.

Further, according to the panel member 10 of the exemplary embodiment, in accordance with a portion of applying the panel member 10, for example, in accordance with a necessary fastening strength or a requested outlook shape or the like of a door, a bonnet or the like, the hem portion 19 only subjected to the curling may be used, and it is not necessarily needed to seam the hem portion 19. That is, it is preferable to properly use the panel member 10 such that the panel member 10 used at a portion requesting a comparatively low fastening strength is subjected only to curling and the panel member 10 used at a portion requesting a higher fastening strength is also subjected to seaming and details thereof will be described later.

Figure 6:
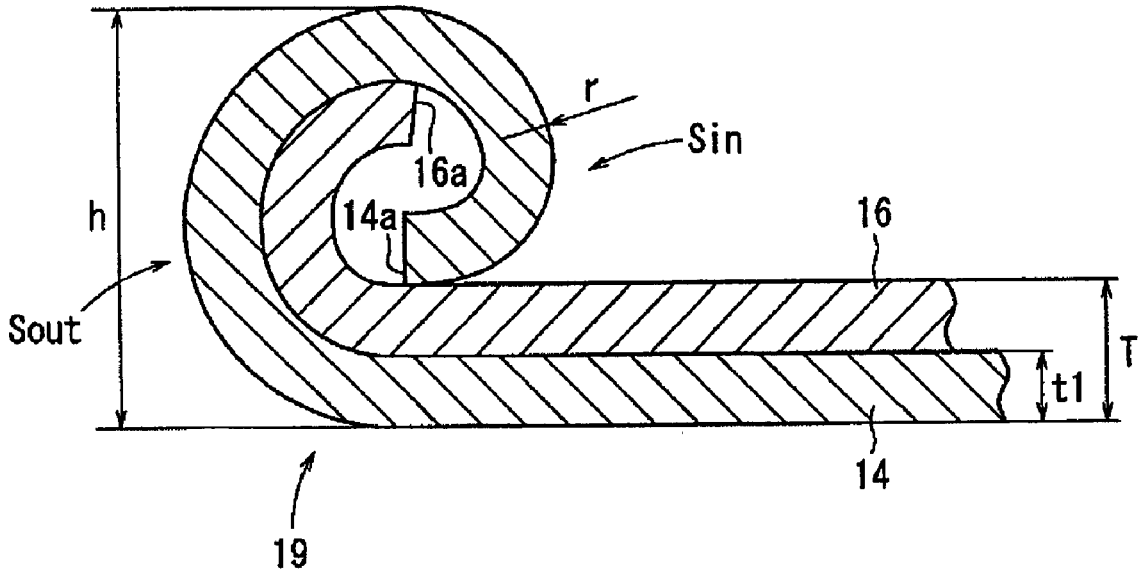
FIG. 6 is a vertical sectional view of the hem portion of the panel member for an automobile after having been curled.

Next, an explanation will be given of an operation and effect of the panel member 10 basically formed as described above mainly in reference to FIG. 6 and FIG. 7. FIG. 6 is a vertical sectional view of the hem portion 19 of the panel member 10 after having been curled, FIG. 7 is a vertical sectional view of the hem portion 18 of the panel member 10 after having been seamed.

Figure 7:
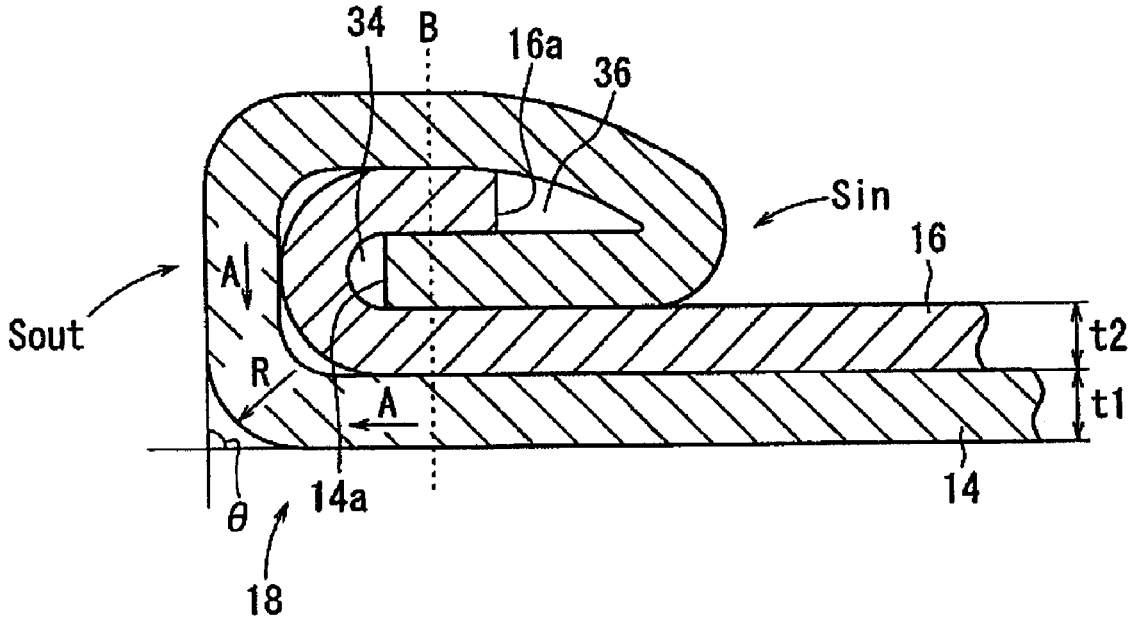
FIG. 7 is a vertical sectional view of the hem portion of the panel member for an automobile after having been seamed.

According to the panel member 10 of the exemplary embodiment, faces of the hem portion 19 after having been curled and the hem portion 18 after having been seamed by bent portions most remote from the front end face 14*a* of the outer panel 14 constituting a plate member on an outermost side and forming outer end portions of the hem portion 19 and the hem portion 18 are referred to as outer side end face Sout, and faces thereof formed on a side opposed to the outer side end face Sout by interposing the front end face 14*a* is referred to as inner side end face Sin as shown by FIG. 6 and FIG. 7.

Further, in this case, it is preferable that a relationship among a radius of curvature R of the inner side end face Sin, a plate thickness t1 of the outer panel 14, a total plate thickness T of the outer panel 14 and the inner panel 16, and a height of an hem portion 19 (height of the outer side end face Sout) h satisfies the following equation (1)

$$t1 < r \leqq (h-T)/2 \quad (1)$$

That is, by satisfying t1<r, the front end face 16*a* of the inner panel 16 is firmly pinched by the outer panel 14 and therefore, a fastening strength can be increased. Further, by satisfying r≦(h−T)/2, when carrying out the curling, the roll-fastening can be carried out while preventing the outer panel 14 from being brought into contact with the front end face 16*a* of the inner panel 16, and the hem portion 19 is prevented from being damaged.

On the other hand, as shown by FIG. 7, when the plate thickness of the outer panel 14 is designated by notation t1, a plate thickness of the inner panel 16 is designated by notation t2, and a circle ratio is designated by notation E, it is preferable that a total area A1 of a gap 34 brought into contact with the front end face 14*a* of the outer panel 14 and a gap 36 brought into contact with the front end face 16*a* of the inner panel 16 satisfies the following equation (2).

$$A1 \geqq \{(t1/2)^2/2\} + \{(t2/2)^2/2\} \cdot \pi \quad (2)$$

That is, when the total area Al of the gap 34 and the gap 36 is equal to or larger than a total area of an area of a semicircle constituting a diameter by the front end face 14*a* and an area of a semicircle constituting a diameter by the front end face 16*a*, sufficient gaps can be ensured at portions brought into contact with the front end face 14*a* and the front end face 16*a* of the outer panel 14 and the inner panel 16 and therefore, even when there are more or less variations in the plate thicknesses or the like of the outer panel 14 and the inner panel 16, the roll-fastening can firmly be carried out.

Further, the above equation (2) is not limited to a case in which plate members roll-fastened are constituted by only two sheets of the outer panel 14 and the inner panel 16 as described above, but is applicable also to a case of three or more sheets thereof. In this case, when a total area of respective gap portions brought into contact with respective front end faces of respective plate members is designated by notation A, and respective plate thicknesses of the respective plate members are designated by notations (t1, t2, . . . , tn), the relationship can be represented by the following equation (3).

$$A \geqq \Sigma\{(ti/2)^{2/}2\}\cdot\pi(i=1, 2, \ldots, n) \quad (3)$$

That is, it is preferable that the total area A of the respective gap portions brought into contact with the respective front end faces of the respective plate members is equal to or larger than a total area of respective semicircles constituting diameters by the respective front end faces of the respective plate members.

Further, as shown by FIG. 7, when an angle e of bending the outer side end face Sout of the hem portion 18 after having been seamed from the outer panel 14 is equal to or smaller than 90°, a portion of the radius of curvature R can sufficiently be reduced, sagging is prevented from being brought about and an outlook of the hem portion 18 is further promoted.

Further, as show by FIG. 7, when the outer panel 14 and the inner panel 16 are brought into contact with each other to be subjected to seaming such that a gap is not produced at the hem portion 18 in a direction of overlapping the outer panel 14 and the inner panel 16 each other (a direction of a dotted line B in FIG. 7), the above-described plastic flow is produced at the hem portion 18 and therefore, a fastening strength at the hem portion 18 is further increased and the outlook is further promoted and therefore, the constitution is preferable.

As described above, according to the panel member 10 of the exemplary embodiment, there is formed the hem portion 18 having a uniform flange even in a case of a three-dimensional hem portion having a number of radii of curvature as in the automobile rear door 12 and therefore, the outlook is promoted.

Further, steps of preventing rust of and coating a seal member on the front end faces 14*a*, 16*a* can be omitted by carrying out the roll-fastening so as to roll-in the front end face 14*a* and the front end face 16*a* of the outer panel 14 and the inner panel 16, and a reduction in cost and a reduction in a number of fabricating steps can be achieved.

Figure 25:
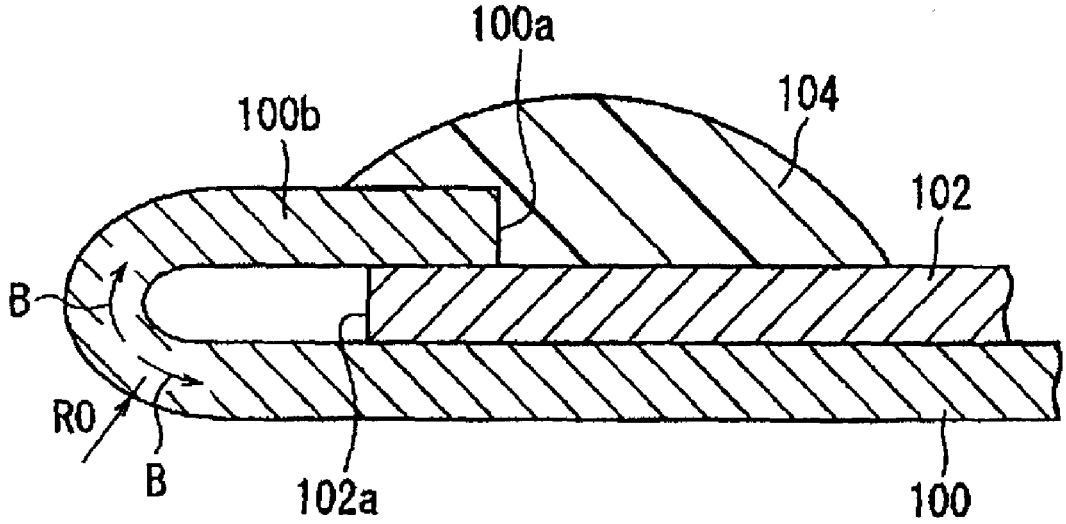
FIG.25 PRIOR ART
FIG. 25 is a vertical sectional view of a hem portion of a panel member for an automobile according to a background method.

Further, by carrying out seaming after curling, the radius of curvature R can be made to be smaller (refer to FIG. 7) than the radius of curvature RO (refer to FIG. 25) of the hemming structure of the background art and therefore, so-to-speak sagging can be restrained and the outlook is further promoted.

Further, in comparison with the hemming structure of the background art, the fastening strength of the hem portion 18 is increased and therefore, the panel member 10 having the further solid hem portion 18 can be provided.

Meanwhile, according to the panel member 10 of the exemplary embodiment, by the above-described constitution, the roll-fastening by curling and seaming can be carried out without being influenced by a difference between the plate thicknesses of the outer panel 14 and the inner panel 16.

Figure 10A:
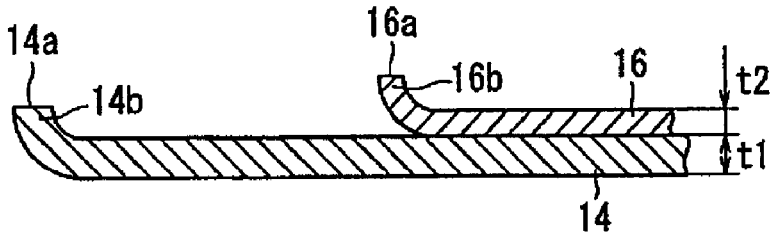
FIG. 10A is a vertical sectional view showing a state of overlapping an outer panel and an inner panel before fastening a hem portion when a plate thickness of the outer panel is thicker than that of the inner panel.
Figure 10B:
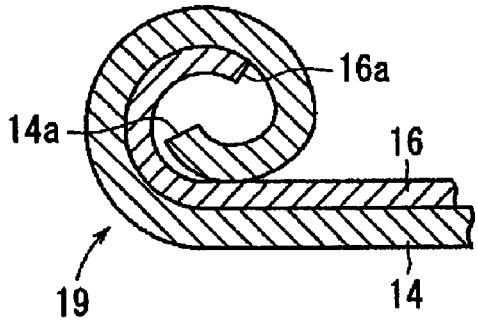
FIG. 10B is a vertical sectional view showing a state of curling the inner panel by the outer panel overlapped thereon.
Figure 10C:
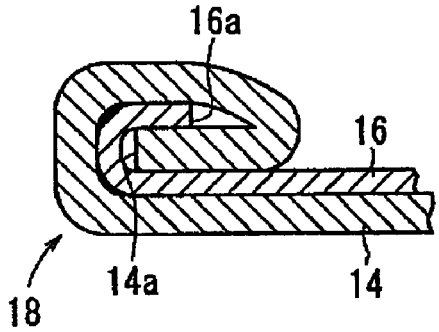
FIG. 10C is a vertical sectional view showing a state of seaming the curled hem portion.

For example, as shown by FIG. 10A, even when the plate thickness t1 of the outer panel 14 is thicker than the plate thickness t2 of the inner panel 16, that is, even when t1>t2, as shown by FIG. 10B and FIG. 10C, the hem portions 18, 19 roll-fastened by being subjected to curling and seaming can be provided.

Figure 11A:
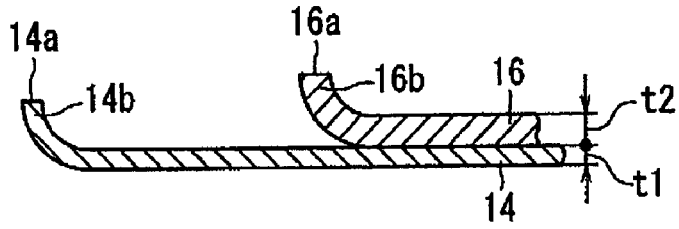
FIG. 11A is a vertical sectional view showing a state of overlapping an outer panel and an inner panel before fastening a hem portion when a plate thickness of the outer panel is thinner than that of the inner panel.
Figure 11B:
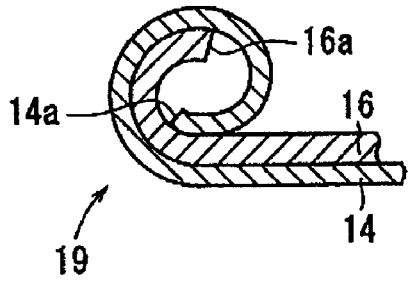
FIG. 11B is a vertical sectional view showing a state of curling the inner panel by the outer panel overlapped thereon.
Figure 11C:
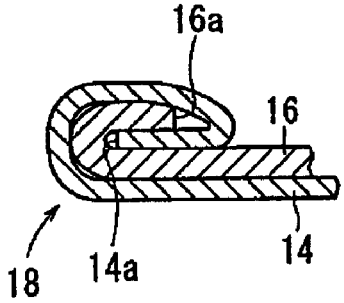
FIG. 11C is a vertical sectional view showing a state of seaming the curled hem portion.

Further, as shown by FIG. 11A, even when the plate thickness t1 of the outer panel 14 is thinner than the plate thickness t2 of the inner panel 16, that is, even when t1<t2, as shown by FIG. 11B and FIG. 11C, the hem portions 18, 19 roll-fastened by being subjected to curling and seaming can be provided.

Further, the invention is not limited to the above-described exemplary embodiment but various modifications and variations can be made to the described exemplary embodiment without departing from the spirit or scope of the invention.

For example, although according to the exemplary embodiment, as the panel member 10, two sheets of plate members of the outer panel 14 and the inner panel 16 are used, the invention is not limited thereto but the panel according to the invention can naturally be embodied even when the plate members are constituted by three or more sheets thereof.

Figure 12:
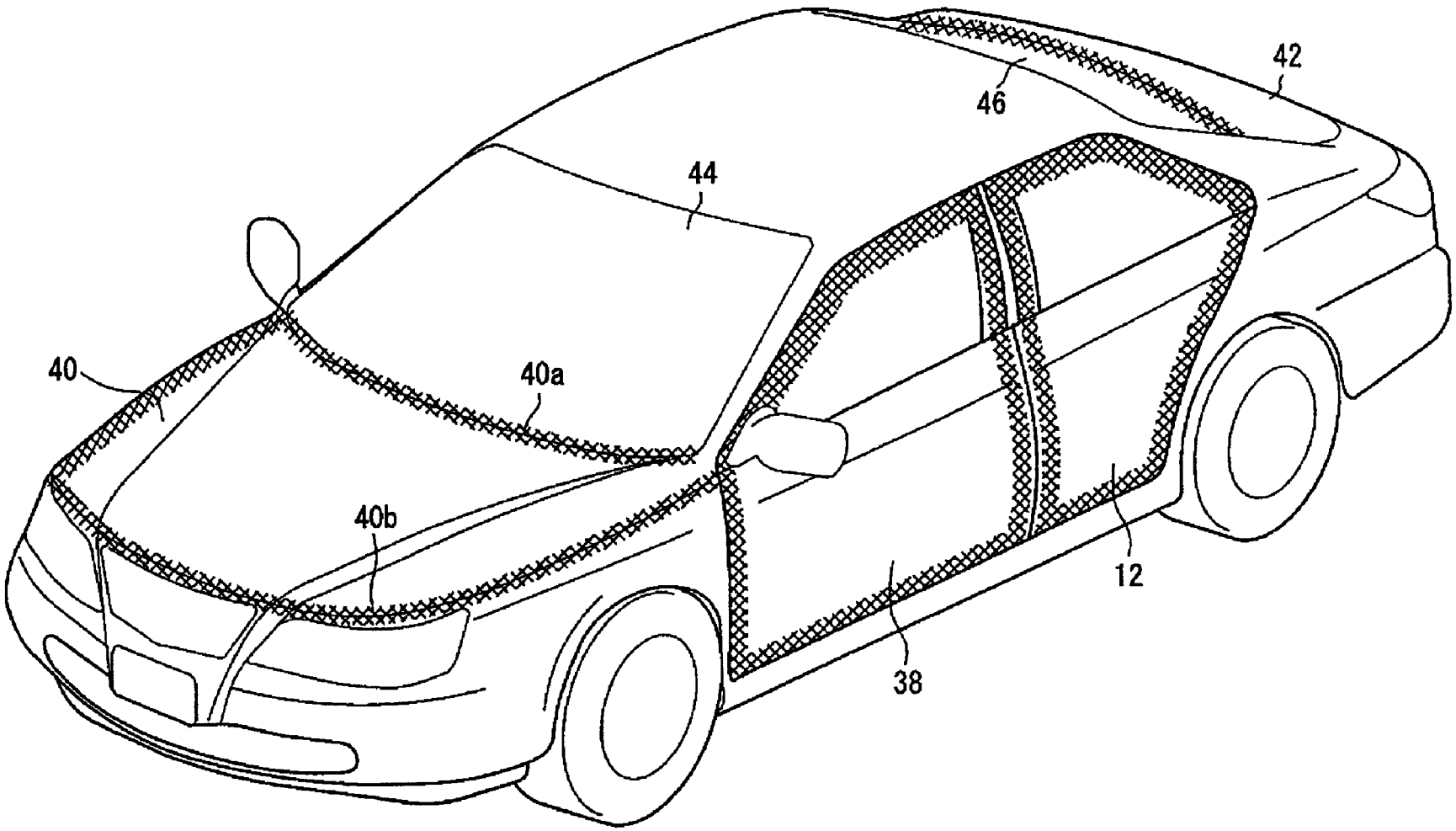
FIG. 12 is a perspective view viewed from a front side of a vehicle body showing a portion of applying the panel member for an automobile to the automobile.
Figure 13:
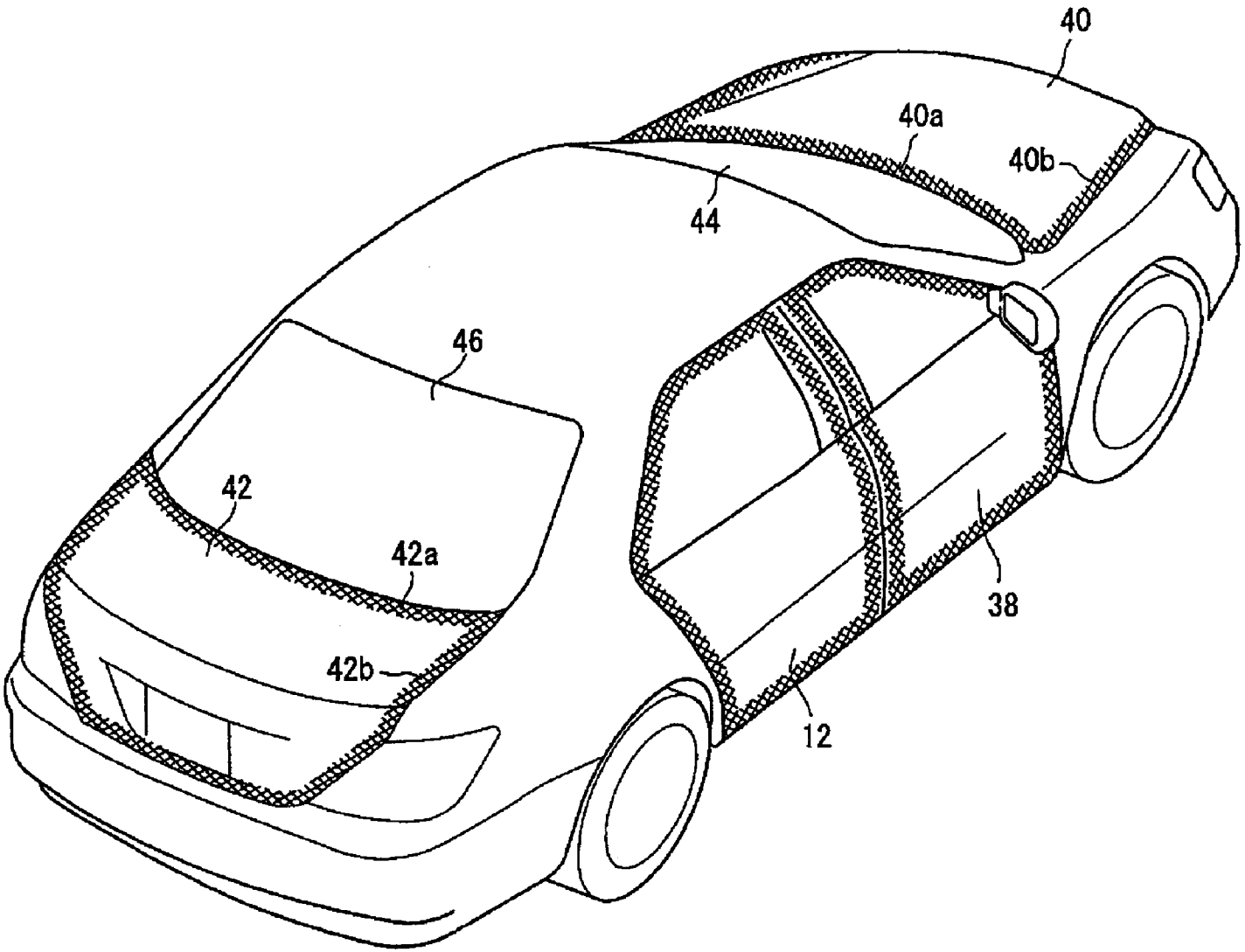
FIG. 13 is a perspective view viewed from a rear side of a vehicle body showing a portion of applying the panel member for an automobile to the automobile.

Further, although an explanation has been given of the panel member 10 of the embodiment by exemplifying the automobile rear door 12, the invention is not limited thereto but the panel member 10 is naturally applicable also to other portion. For example, as portions of applying the panel member 10, as shown by FIG. 12 and FIG. 13, an automobile front door 38, a bonnet 40, a trunk 42 and the like can be enumerated.

Further, as described above, according to the panel member 10 of the exemplary embodiment, a case of forming the hem portion 19 subjected only to curling and a case of forming the hem portion 18 subjected to seaming can be selected in accordance with use thereof. Therefore, for example, explaining by taking examples of the bonnet 40 and the trunk 42, a hem portion 40*a* opposed to front glass 44 of the bonnet 40 and a hem portion 42*a* opposed to rear glass 46 of the trunk 42 may be subjected only to curling. On the other hand, a hem portion 40*b* other than the hem portion 40*a* of the bonnet 40 and a hem portion 42*b* other than the hem portion 42*a* of the trunk 42 may be subjected also to seaming.

<Second Exemplary Embodiment>

Figure 14:
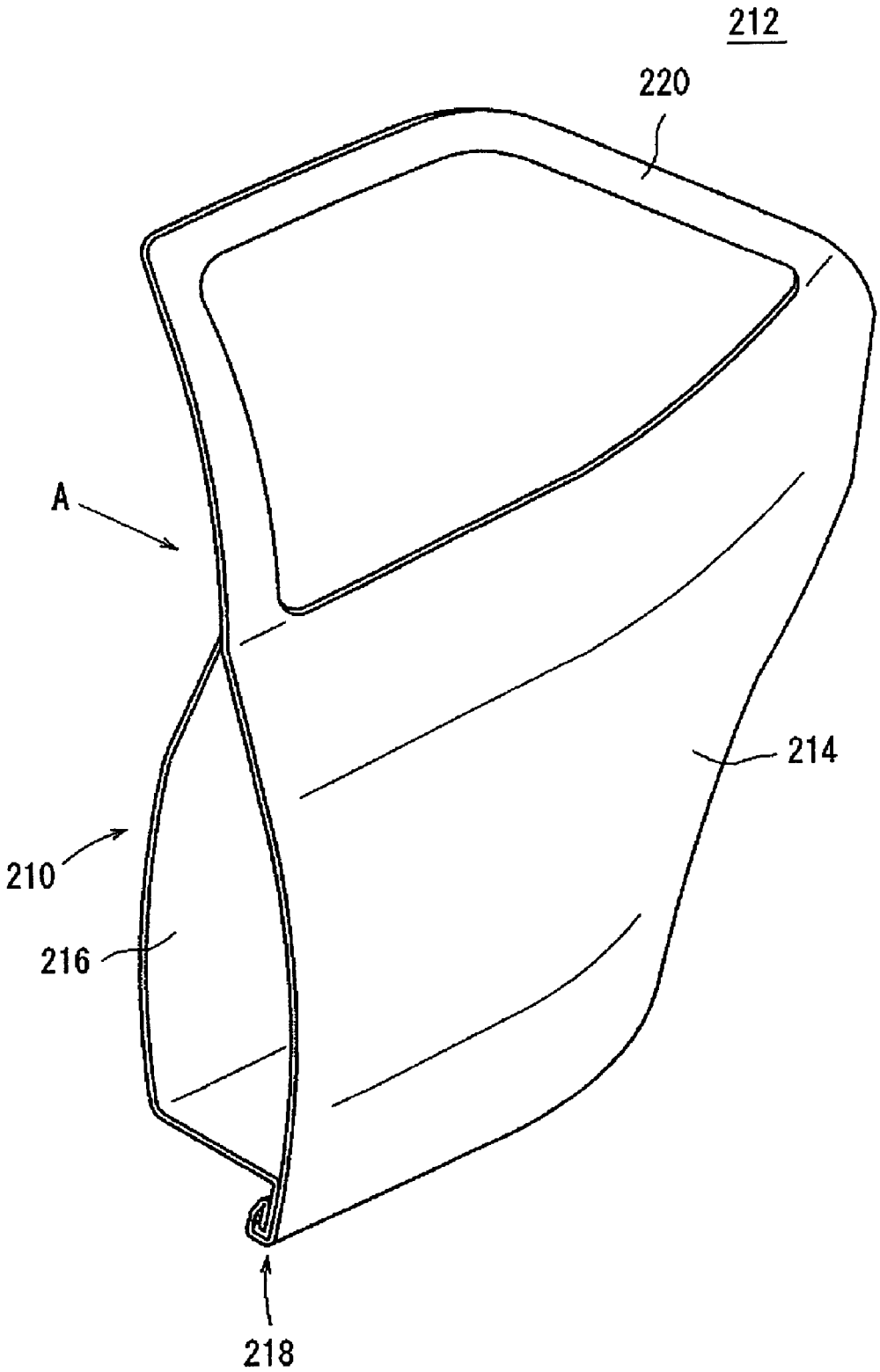
FIG. 14 is a partial perspective view of an automobile rear door constituting an example of applying a panel having a panel structure according to an embodiment of the invention.
Figure 15:
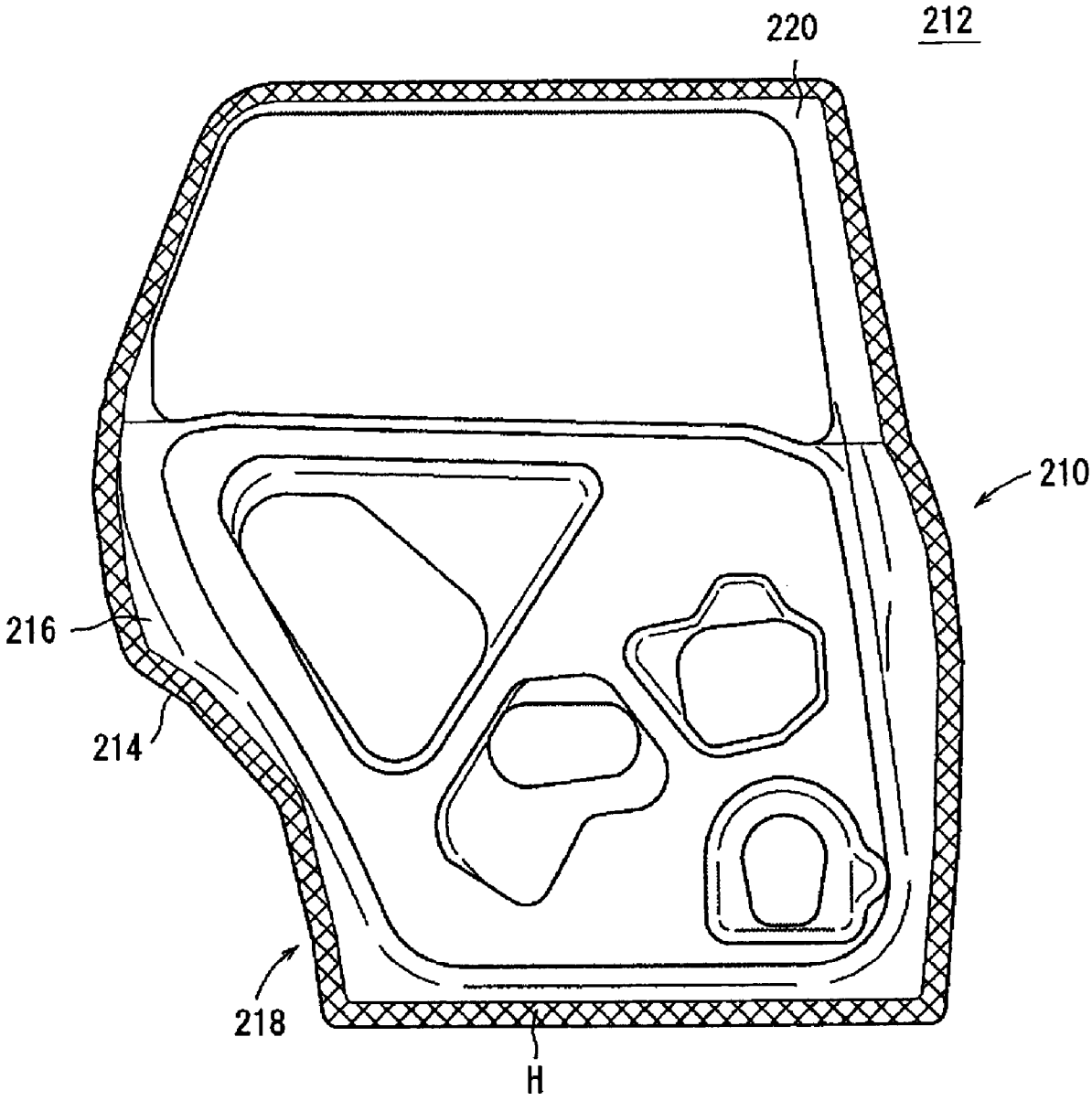
FIG. 15 is a front view of the automobile rear door viewed from an A arrow mark direction in FIG. 14.

FIG. 14 is a partial perspective view of an automobile rear door 212 constituting an example of applying a panel 210 having a panel structure according to a second exemplary embodiment of the invention. FIG. 15 is a front view of the automobile rear door 212 viewed from an A arrow mark direction in FIG. 14 (a direction of viewing the automobile rear door 212 from a vehicle inner side).

The automobile rear door 212 is constituted by the panel 210 formed by roll-fastening an outer panel 214 (first panel) and an inner panel 216 (second panel) by a hem portion 218, and a window frame 220 attached to an upper portion of the panel 210. The outer panel 214 and the inner panel 216 are, for example, sheet metal materials (made of metal) punched in predetermined shapes.

The hem portion 218 fastened by the roll-fastening is a portion indicated by, for example, a strip-like netted portion H of FIG. 15, and is three-dimensionally extended over an entire periphery of the automobile rear door 212. Further, the hem portion 218 is formed to be roll-fastened in a state of rolling-in a front end face 214*a* of the outer panel 214 and a front end face 216*a* of the inner panel 216 as shown by FIG. 16C or FIG. 16D.

Next, an explanation will be given of an example of a panel fastening method constituting a method of forming the hem portion 218 roll-fastened as described above in reference to FIG. 16A through FIG. 19.

Figure 16A:
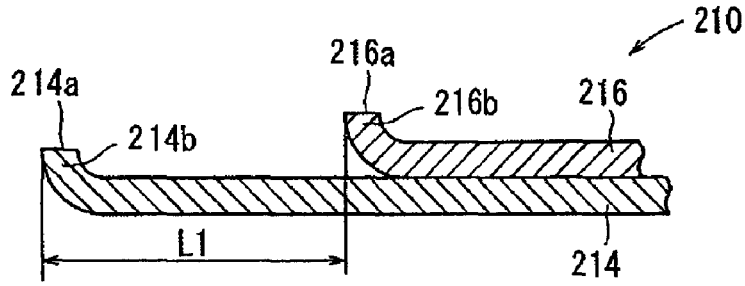
FIG. 16A is a partially omitted vertical sectional view showing a state of overlapping to position an outer panel and an inner panel for fastening the panel.
Figure 16B:
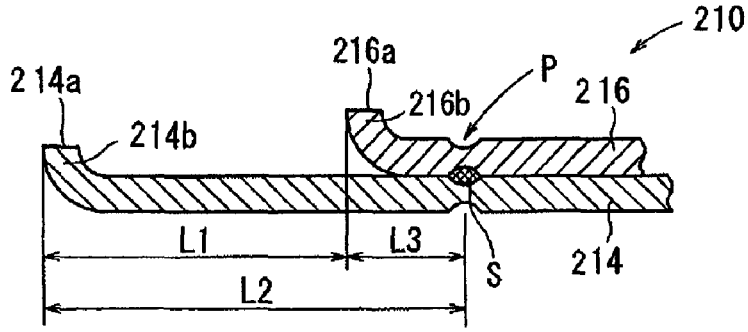
FIG. 16B is a partially omitted vertical sectional view showing a state of bonding the outer panel and the inner panel which are positioned.
Figure 16C:
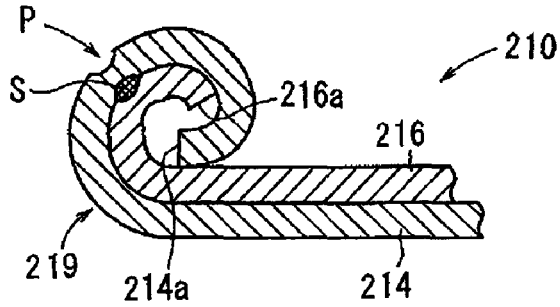
FIG. 16C is a partially omitted vertical sectional view showing a state of curling the outer panel and the inner panel after having been bonded as described above.
Figure 16D:
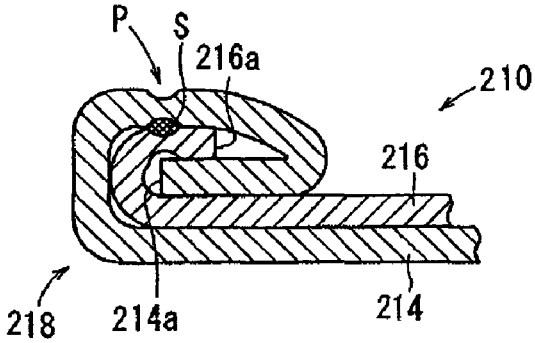
FIG. 16D is a partially omitted vertical sectional view showing a state of seaming a hem portion curled as described above.

FIG. 16A is a partially omitted vertical sectional view showing a state of overlapping the outer panel 214 and the inner panel 216 to position before fastening the panel 210 according to the second exemplary embodiment, FIG. 16B is a partially omitted vertical sectional view showing a state of bonding the outer panel 214 and the inner panel 216 which has been positioned as described above, FIG. 16C is a partially omitted vertical sectional view showing a state of forming a hem portion 219 by forming to roll-fastening (curling) the outer panel 214 and the inner panel 216 substantially in a circular shape from front ends thereof after having been bonded as described above, FIG. 16D is a partially omitted vertical sectional view showing a state of forming the hem portion 218 by forming (seaming) the hem portion 219 while deforming (pressing) the curled hem portion 219 to be flat.

First, as shown by FIG. 16A, the outer panel 214 and the inner panel 216 are overlapped. At this occasion, the outer panel 214 is shifted from the inner panel 216 by a distance L1 to overlap to thereby position the outer panel 214 and the inner panel 216 relative to each other (positioning step). Further, at this occasion, front end portions of the outer panel 214 and the inner panel 216 including the front end face 214*a* and the front end face 216*a* are previously bent more or less to form a flange portion 214*b* and a flange portion 216*b* (preparatory bending).

Next, as shown by FIG. 16B, the outer panel 214 and the inner panel 216 are bonded at a position P (bonding portion P) at a distance L2 from the front end of the outer panel 214 and at a distance L3 from the front end of the inner panel 216 (bonding step). By carrying out bonding at the position P, relative to the bonding position P after bonding, the outer panel 214 and the inner panel 216 are provided with unfixed portions (plays) of the distances L2, L3 respectively in directions of the front ends, and a deviation or the like is permitted at the unfixed portions in the outer panel 214 and the inner panel 216. Therefore, in roll-fastening described later, a wrinkle is effectively restrained from being brought about and forming is facilitated.

Figure 17:
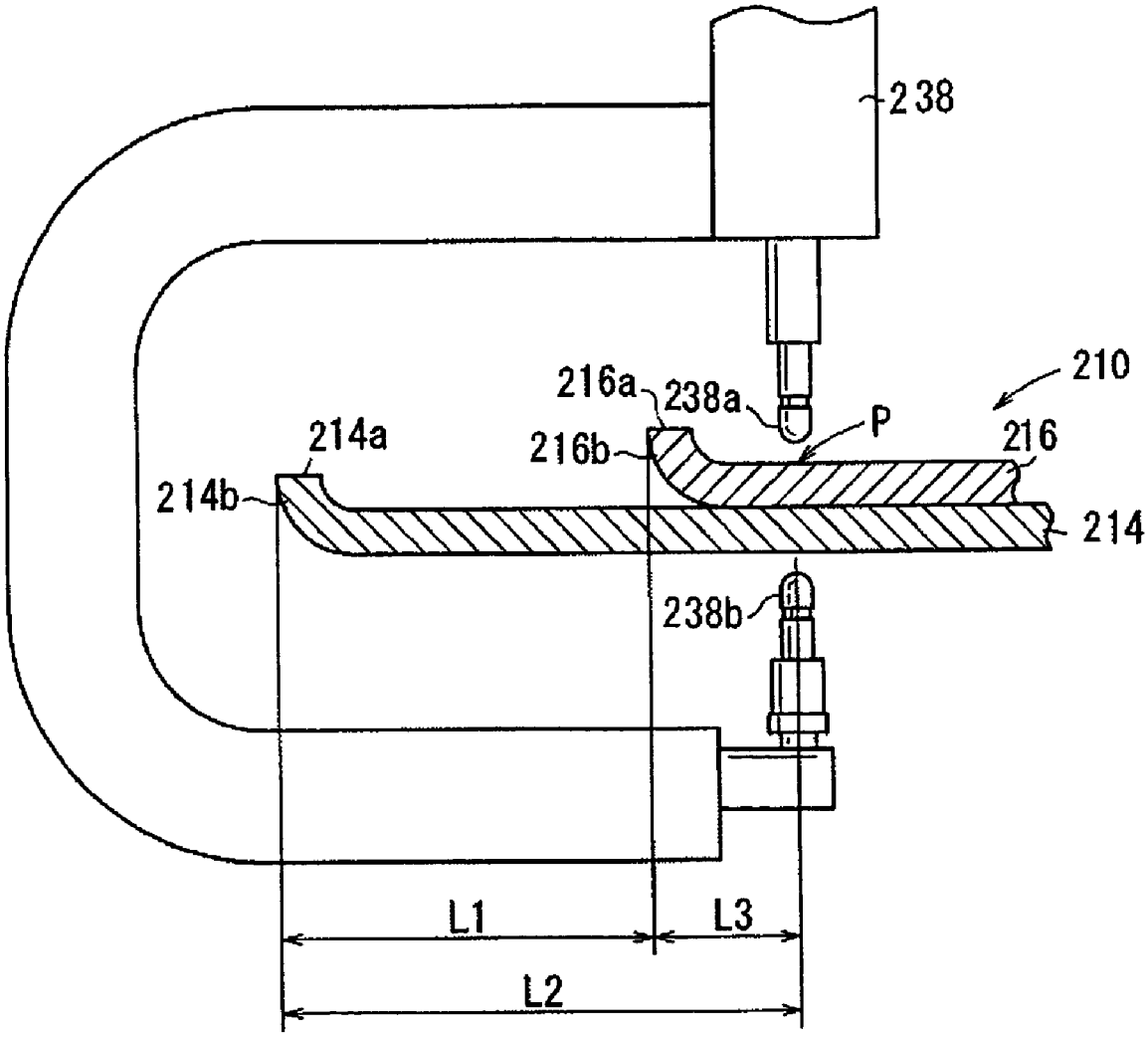
FIG. 17 is an explanatory view showing an example of a method of bonding the outer panel and the inner panel.

As a bonding method in this case, according to the exemplary embodiment, the outer panel 214 and the inner panel 216 are bonded by subjecting the position P to spot welding S. The spot welding S may be carried out by using a spot welding apparatus 238 of a C gun type to the position P of overlapping the outer panel 214 and the inner panel 216 as shown by FIG. 17. That is, the outer panel 214 and the inner panel 216 are bonded by using the C gun type spot welding apparatus 238 without using the back bar of the background art. Thereby, the outer panel 214 and the inner panel 216 are sufficiently pressed from two upper and lower faces thereof, during which a welding current is conducted and therefore, the panels are bonded by a sufficient strength. Further, reference notations 238*a*, 238*b* in FIG. 17 designate electrode tips of the spot welding apparatus 238.

Further, the method of bonding the outer panel 214 and the inner panel 216 may achieve a sufficient bonding strength and other than the spot welding, for example, friction agitation bonding, laser welding or bonding by an adhering agent and the like are enumerated.

Next, as shown by FIG. 16C, the hem portion 219 substantially in a circular shape is formed by carrying out curling (roll-fastening) from the front end of the outer panel 214 shifted from the inner panel 216 by the distance L1 (forming step).

Figure 18:
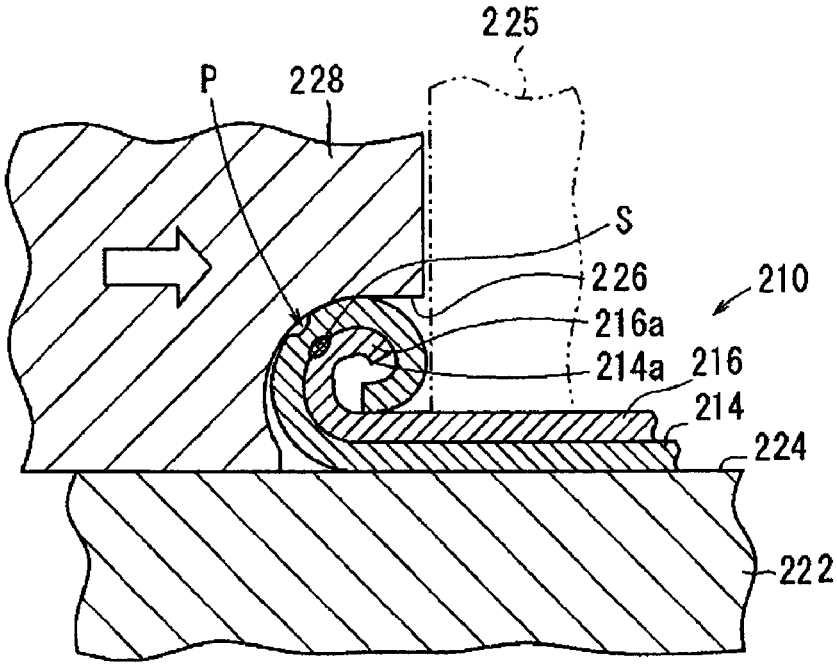
FIG. 18 is an explanatory view showing an example of a method of curling the hem portion of the panel.

As a curling method in this case, for example, as shown by FIG. 18, the outer panel 214 and the inner panel 216 which are bonded are mounted on a mounting face 224 of a mounting base 222, and roll-fastened by moving a curl punch 228 having a curl portion 226 slidingly in an arrow mark direction above the mounting face 224.

At this occasion, the outer panel 214 and the inner panel 216 are positioned to each other by being spaced apart from each other by the distance L1 and bonded by the sufficient strength. Therefore, in the curl forming, it is not necessary to position to fix the outer panel 214 and the inner panel 216 by, for example, a press pad 225 (indicated by two-dotted chain lines in FIG. 18), further, positions of the outer panel 214 and the inner panel 216 are not shifted from each other. Therefore, the hem portion 219 excellent in an outlook shape can easily be provided.

Further, as described above, the outer panel 214 and the inner panel 216 are provided with the unfixed portions (plays) of the distances L2, L3 respectively in directions of the front ends relative to the bonding portion P and therefore, a wrinkle can effectively be restrained from being brought about in roll-fastening and also forming is facilitated.

Figure 20:
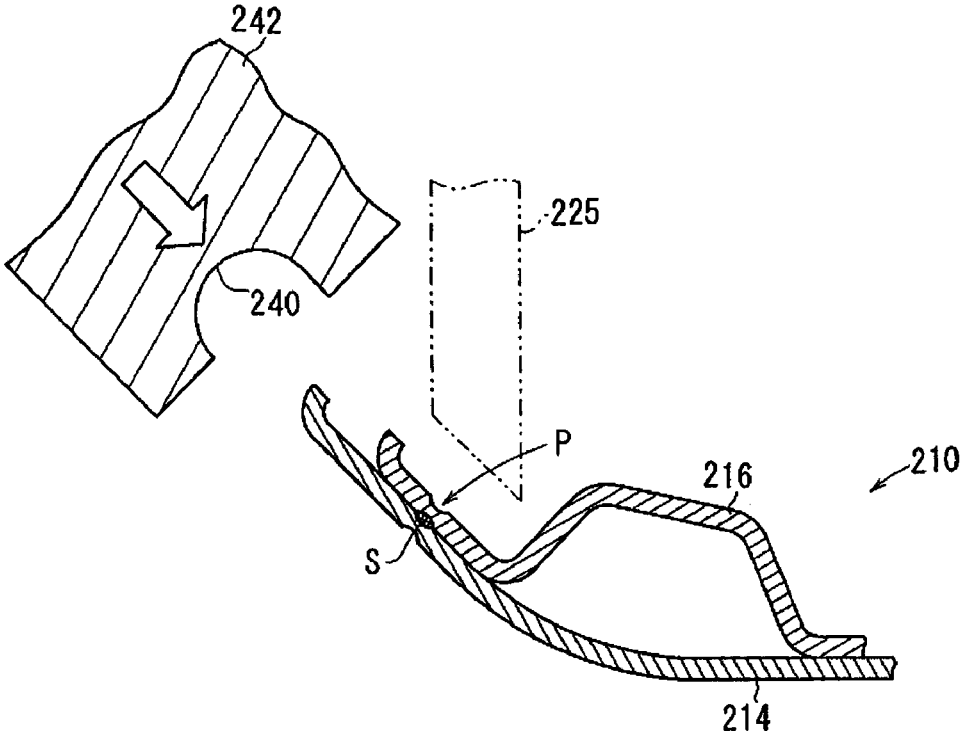
FIG. 20 is an explanatory view showing an example of applying a curl-forming to a panel having a shape of being considerably warped to an upper side.
Figure 21:
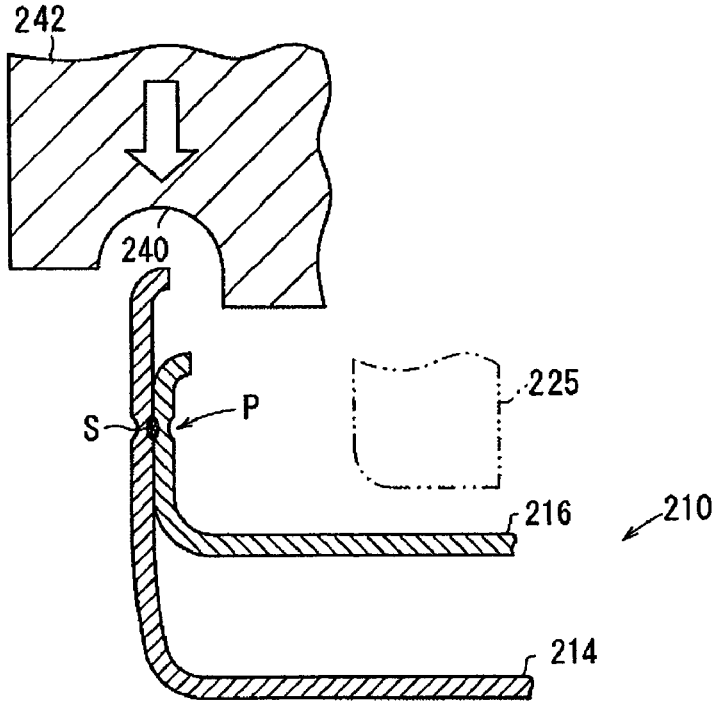
FIG. 21 is an explanatory view showing an example of applying the curling to a panel having a shape by which the panel is difficult to be fixed by a press pad.

Further, as described above, fixing by the press pad 225 or the like in curling is not needed. Therefore, curling can easily be carried out by using a curl punch 242 having a curl portion 240 in, for example, substantially a semicircular shape even for the panel 210 (refer to FIG. 20) by which the curl punch 242 and the press pad 225 interfere with each other owing to a shape thereof considerably warped to an upper side, or the panel 210 (refer to FIG. 21) of a shape which is difficult to be fixed by the press pad 225.

Next, as shown by FIG. 16D, the hem portion 218 is formed by being subjected to aseaming process in which the hem portion 219 is pressed and deformed to be flat.

Figure 19:
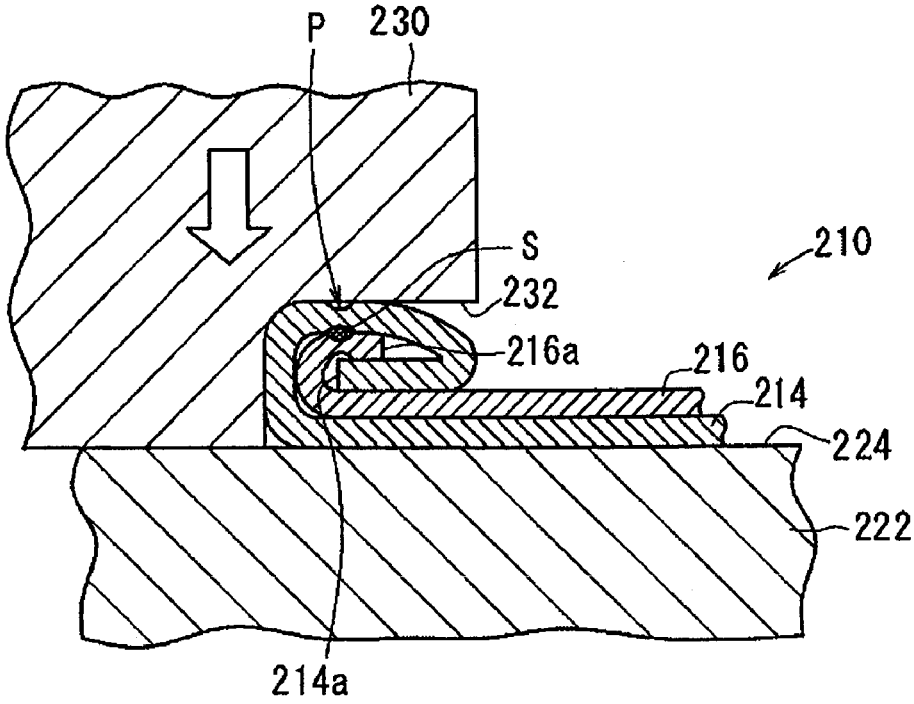
FIG. 19 is an explanatory view showing an example of method of seaming the hem portion of the panel.

According to the seaming process in this case, for example, after curling above the mounting face 224, the curl punch 228 is escaped from the formed hem portion 219, as shown by FIG. 19, seaming is carried out while deforming the hem portion 219 to be flat by a seam portion 232 of a seam punch 230. At this occasion, in a procedure of deforming the hem portion 219 to the hem portion 218 to be flat, a plastic flow is produced in the outer panel 214 and the inner panel 216. Further, by the plastic flow, a radius of curvature R of the hem portion 218 can sufficiently be reduced by operating a force in an arrow mark A direction (direction directed to R portion) of FIG. 23, sagging is prevented from being brought about and therefore, the hem portion 218 having a further excellent outlook can easily be provided.

Further, according to the panel 210 of the embodiment, the hem portion 219 subjected only to the curling may be formed to use and it not necessarily needed to subject the hem portion 219 to seaming in according with a portion of applying the panel 210, for example, when an example is taken for an automobile, in accordance with a fastening strength necessary for each portion of a door, a bonnet or the like or a required outlook shape or the like. That is, for example, the seaming may properly be used such that the panel 210 used at a portion at which a request for the fastening strength is comparatively low is subjected only to curling, and the panel 210 used at a portion at which the request of the fastening strength is higher is subjected also to seaming.

Figure 28:
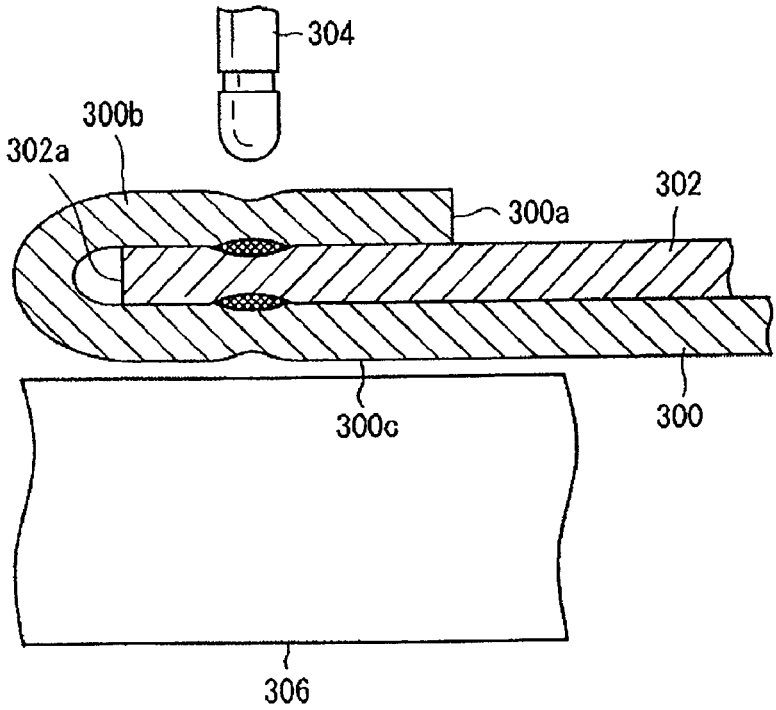
FIG.28 PRIOR ART
FIG. 28 is a partially omitted vertical sectional view for explaining a panel structure fastened by a background art method.

Further, according to the panel 210, other than the roll-fastening method shown in FIG. 18 and FIG. 19, there may be constituted a method in which, for example, the outer panel 214 and the inner panel 216 which are overlapped are subjected to a bonding step, thereafter, the hem flange portion 300*b* is folded to bend by hemming as in the background art constitution shown in FIG. 28, further, the hem portion per se is folded back by constituting a fulcrum by a portion of the front end face 300*a* in FIG. 28.

Figure 22:
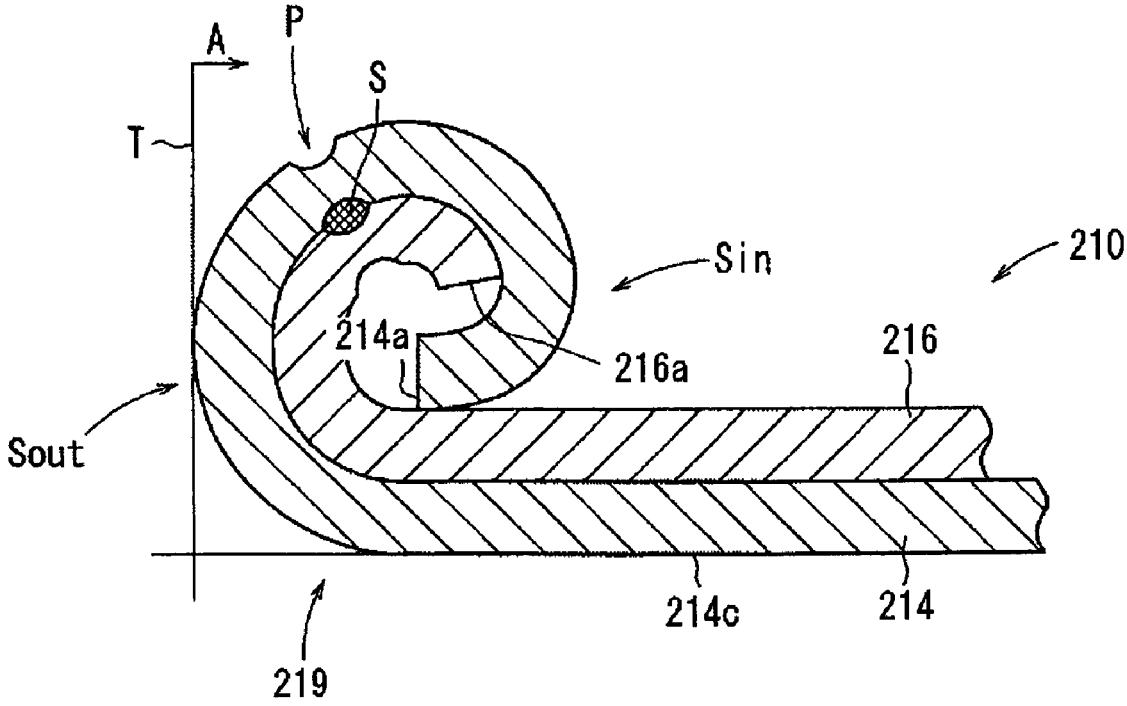
FIG. 22 is a partially omitted vertical sectional view of the hem portion of the panel after having been curled.

Next, an explanation will be given of operation and effect of the panel 210 basically formed as described above mainly in reference to FIG. 22 and FIG. 23. FIG. 22 is a partially omitted vertical sectional view of the hem portion 219 of the panel 210 after having been curled, FIG. 23 is a partially omitted vertical sectional view of the hem portion 218 of the panel 210 after having been seamed.

Figure 23:
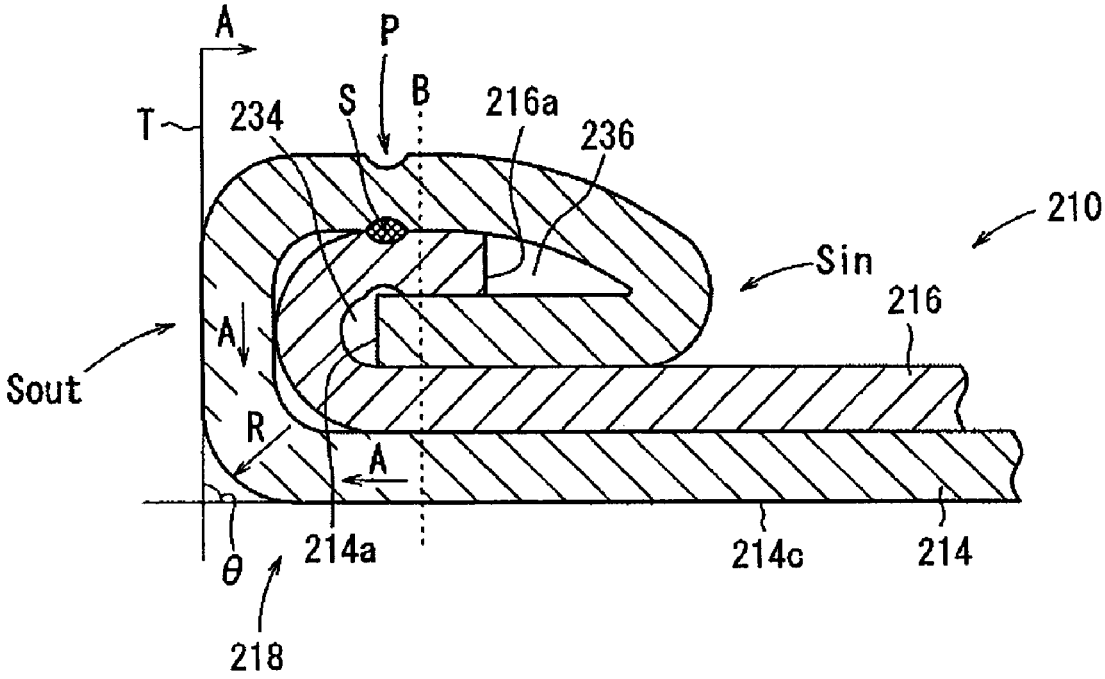
FIG. 23 is a partially omitted vertical sectional view of the hem portion of the panel after having been seamed.

Further, according to the panel 210, as shown by FIG. 22 and FIG. 23, faces of the hem portion 219 after having being curled and the hem portion 218 after having been seamed bent from an outer surface 214*c* of the outer panel 214, that is, faces thereof forming outer end portions of the hem portion 219 and the hem portion 218 are referred to as outer side end face Sout, and faces thereof formed on a side opposed to the outer side end face Sout by interposing the front end face 214*a* is referred to as inner side end face Sin. In this case, an outer end portion of the hem portion 219 or the hem portion 218 can also be referred to as an end portion formed on a side opposed to an end portion (a face of forming the inner side end face Sin in FIG. 22 and FIG. 23) formed in a direction of seaming the outer panel 214 (direction directed to an inner side of the panel 210 constituting a work), that is, formed in a direction reverse to a direction of seaming the outer panel 214.

According to the panel 210 of the exemplary embodiment, as described above, the outer panel 214 and the inner panel 216 are overlapped to position, thereafter, subjected to the spot welding S by using the spot welding apparatus 238 of the C gun type to be bonded to each other. Therefore, a strike mark by the spot welding S is formed not only at the inner panel 216 but also at the outer surface 214*c* of the outer panel 214. Further, when the strike mark is disposed at the outer surface of the panel 210, an outlook of the panel 210 as a product is considerably deteriorated.

Hence, according to the exemplary embodiment, as shown by FIG. 22 and FIG. 23, curling (seaming) is carried out such that the strike mark at the bonding portion P is included in the hem portion 218, 219 to effectively prevent the strike mark from being disposed at the outer surface of the panel 210.

In this case, when the hem portion 219 formed by curling is roll-fastened to form until the bonding portion P arrives at the side of the inner side end face Sin relative to a tangential line T of the outer side end face Sout intersected substantially orthogonal to a linear line along the outer surface 214*c* of the outer panel 214 (arrow mark A direction of FIG. 22), the bonding portion P is not conspicuous, which is particularly preferable in view of the outlook. Similarly, when the bonding portion P (strike mark) is disposed in the arrow mark A direction relative to the tangential line T also in the hem portion 218 after having been seaming as shown by FIG. 23, the bonding portion P is not conspicuous, which is particularly preferable in view of the outlook.

In this way, according to curling or seaming, when roll-fastening is carried out such that the bonding portion P is disposed on an inner side of the outer side end face Sout of the hem portion 218, 219, that is, to the inner side of the panel 210 (work) relative to the outer side end face Sout, the hem portion 218, 219 having an excellent outlook can be provided.

Meanwhile, according to the background art constitution, a strike mark is prevented from appearing at an outer surface of a product by carrying out welding in a state in which the back bar is butted to the outer surface after fastening the hem portion and therefore, as described above, there poses the problem that the sufficient pressing cannot be carried out in welding and the bonding strength is insufficient.

In contrast thereto, according to the exemplary embodiment, the bonding is carried out before fastening the panel 210 and therefore, in comparison with a case of bonding after fastening the hem portion as in the background art constitution, the bonding operation is facilitated, and the bonding can be carried out by a sufficient strength. Further, the hem portion 218, 219 is formed by curling or seaming as described above and therefore, the fastening strength of the hem portion 218, 219 is higher than that of the hemming structure as in the background art. Further, the outer panel 214 and the inner panel 216 are fastened to roll-in the front end face 214*a* and the front end face 216*a* and therebefore, the front end faces 214*a*, 216*a* can considerably be restrained from being rusted.

Further, according to the exemplary embodiment, after the bonding, the curling is carried out such that the bonding portion P is concealed to the inner side of the work from the outer surface of the panel 210 (the outer surface 214*c* and the outer side end face Sout of the outer panel 214). Therefore, the outer panel 214 and the inner panel 216 can be fastened by the sufficient fastening strength while preventing a situation in which the bonding portion P (strike mark) appears at the outer surface of the panel 210 to deteriorate the outlook of the product.

Further, as shown by FIG. 23, when an angle Θ for bending the outer side end face Sout at the hem portion 218 after having been seamed from the outer panel 214 is equal to or smaller than 90°, the radius of curvature R can sufficiently be reduced, sagging is prevented from being brought about and the outlook of the hem portion 218 is further promoted. Further, as shown by FIG. 23, when the outer panel 214 and the inner panel 216 are brought into contact with each other to be subjected to seaming such that a gap is not produced in a direction of overlapping the outer panel 214 and the inner panel 216 each other (a direction of a dotted line B in FIG. 23) at the hem portion 218, the plastic flow is produced at the hem portion 218 and therefore, the fastening strength of the hem portion 218 is further increased and the outlook is further promoted and therefore, the seaming is preferable.

Figure 24:
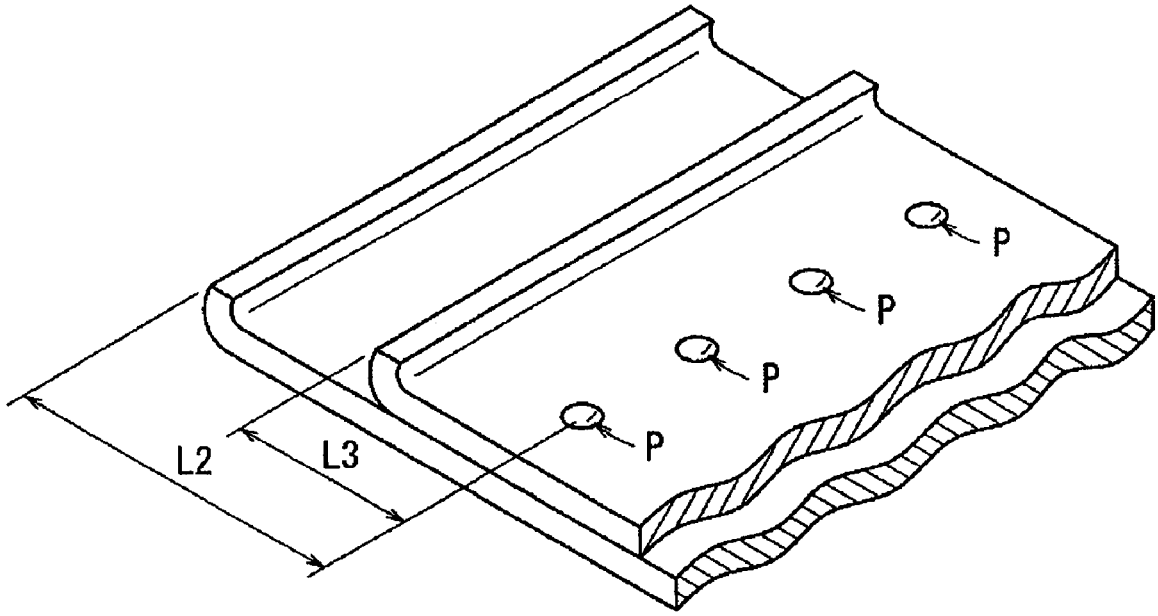
FIG. 24 is an outline perspective view showing an example of a bonding portion in the bonding step.

According to the panel 210 of the embodiment, the spot welding S at the bonding step may further be carried out at a plurality of portions at predetermined intervals on the hem portions of the outer panel 214 and the inner panel 216 (refer to FIG. 24).

When constituted in this way, in curling, the outer panel 214 and the inner panel 216 are bonded by being positioned to each other and therefore, the panels are not shifted from each other, and the panels are brought into a state of permitting a small amount of shift or elongation or contraction of the individual panels among the respective bonding portions P. Therefore, in curling, an interval between the bonding portion P and the bonding portion P (non-bonded portion) functions as a buffer portion and therefore, a wrinkle constituting a reference by the bonding portion P can considerably be restrained.

Further, the invention is not limited to the above-described embodiment but various constitutions thereof can naturally be adopted without deviating from the gist of the invention.

For example, although according to the embodiment, an explanation has been given such that the panel 210 is constituted by two sheets of the outer panel 214 and the inner panel 216, the invention is not limited thereto but the panel 210 may be constituted by three or more of sheets thereof.

Further, although an explanation has been given of the panel 210 of the embodiment by exemplifying the automobile rear door 212, the invention is not limited thereto but is naturally applicable to other portion. For example, as respective portions of the automobile, a front door, a bonnet, a trunk and the like are enumerated, further, a range of applying the panel 210 is not naturally limited to the automobile use.

Further, the curling method and the seaming method shown in FIG. 18 and FIG. 19 or the like are examples for realizing the invention and the invention is not naturally limited thereto.

What is claimed is:

1. A panel member for an automobile comprising:

a hem portion at which a plurality of overlapped plate members are fastened, wherein the hem portion is roll-fastened in a state that respective front end faces of the respective plate members are rolled-in, wherein an outer side end face of the roll-fastened hem portion is deformed to be flat.

2. The panel member according to claim 1, further comprising:

the outer side end face provided on a face of the hem portion formed by a bent portion most remote from the front end face of the plate member on an outermost side and forming an outer end portion of the hem portion; and an inner side end face provided on a face of the hem portion formed on a side opposed to the outer side end face of the plate member on the outermost side by interposing the front end face, wherein a radius of curvature of the inner side end face is designated by a notation (r), a total plate thickness of the respective plate members is designated by a notation (T), a plate thickness of the plate member on the outermost side is designated by notation (t1), a height of the outer side end face is designated by a notation (h), and $$t1<r\leqq(h-T)/2,$$

wherein by satisfying t1<r, a front end face of the plate member on the innermost side is firmly pinched by the outermost side plate member, and by satisfying r≦(h−T)/2, the outermost side plate member is prevented from being brought into contact with the front end face of the innermost side plate member.

3. The panel member according to claim 1, wherein the respective plate members are brought into contact with each other without producing a gap in a direction of overlapping the respective plate members each other at the hem portion.

4. The panel member according to claim 3, wherein, in a section of the hem portion cut in a plate thick direction of the plate member, a total area of respective gap portions brought into contact with the respective front end faces of the respective plate members which are rolled-in is designated by a notation (A), plate thicknesses of the respective plate members are designated respectively by notations (t1, t2, . . ., tn), a circle rate is designated by a notation (π), and $$A\geqq\Sigma\{(ti/2)^2/2\}\pi(i=1, 2, \ldots, n),$$

wherein by satisfying the above equation for total area A, roll-fastening of the hem portion can be firmly carried out with variations in plate thicknesses on the respective plate members.

5. The panel member according to claim 1, further comprising:

the outer side end face provided on a face of the hem portion formed by a bent portion most remote from the front end face of the plate member on an outermost side and forming an outer end portion of the hem portion, wherein an angle of bending the outer side end face from the plate member is equal to or smaller than 90°.

6. A panel structure comprising:

a hem portion at which a plurality of overlapped panels are fastened; and a bonding portion at which the respective panels are bonded with each other, the bonding portion defining a mark on an outer surface of an outermost panel of the plurality of panels, wherein the bonded respective panels are roll-fastened so as to roll-in respective front end faces of the respective panels, and so as to visibly dispose the bonding portion only in an inner side of the hem portion.

7. The panel structure according to claim 6, wherein the bonding portion is disposed at a position in an inner side of an outer side end face provided on the outermost panel of the hem portion.

* * * * *